US007785088B2

(12) United States Patent
Taniguchi et al.

(10) Patent No.: US 7,785,088 B2
(45) Date of Patent: Aug. 31, 2010

(54) SCROLL FLUID MACHINE WITH A COATING LAYER

(75) Inventors: Keisuke Taniguchi, Isehara (JP); Yoshiyuki Kanemoto, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 95 days.

(21) Appl. No.: 12/010,736

(22) Filed: Jan. 29, 2008

(65) Prior Publication Data

US 2008/0181802 A1 Jul. 31, 2008

(30) Foreign Application Priority Data

Jan. 31, 2007 (JP) ..... 2007-022163

(51) Int. Cl.
*F01C 1/02* (2006.01)

(52) U.S. Cl. ..... 418/55.2; 418/178; 418/179

(58) Field of Classification Search ..... 418/55.2, 418/178, 179
See application file for complete search history.

(56) References Cited

U.S. PATENT DOCUMENTS 4,802,831 A * 2/1989 Suefuji et al. ..... 418/55.2
5,803,723 A * 9/1998 Suefuji et al. ..... 418/55.2
2008/0159894 A1* 7/2008 Kanemoto ..... 418/55.2

FOREIGN PATENT DOCUMENTS

JP 2005-76517 3/2005
JP 2005076517 A * 3/2005

OTHER PUBLICATIONS

JIS Japanese Industrial Standard JIS K 5600-5-3: 1999, "Testing methods for paints—Part 5: Mechanical property of film—Section 3: Falling-weight test", 2000, Japanese Standards Association, JIS K5600-5-3, English edition.*
JIS Japanese Industrial Standard JIS K 5600-5-4: 199 (ISO/DIS 15184:1996), "Testing methods for paints—Part 5: Mechanical property of film—Section 4: Scratch hardness (Pencil method)", 2000, Japanese Standards Association, JIS K5600-5-3, English edition.*
International Standard ISO 15184, "Paints and varnishes—Determination of film hardness by pencil test", Nov. 1, 1998, ISO.*

(Continued)

*Primary Examiner*—Thomas E Denion
*Assistant Examiner*—Mary A Davis
(74) *Attorney, Agent, or Firm*—Crowell & Moring LLP

(57) ABSTRACT

A scroll fluid machine that is capable of preventing a power loss and enhancing the degree of hermeticity of compression chambers. A plurality of outer peripheral projections are formed on an outer peripheral surface of a wrap portion of each scroll. An outer peripheral coating layer is formed on an outer peripheral surface of a wrap portion of a fixed scroll, and an inner peripheral coating layer is formed on an inner peripheral surface of the wrap portion. Each of the coating layers comprises: contact portions that make contact with the mating wrap portion; and non-contact portions that do not make contact with the mating wrap portion. In this way, the degree of hermeticity of the compression chambers can be enhanced by the contact portions, and power loss can be prevented by the non-contact portions.

20 Claims, 16 Drawing Sheets

OTHER PUBLICATIONS

International Standard ISO 6272-1, "Paints and varnishes—Rapid-deformation (impact resistance tests—Part 1: Falling-weight test, large-area indenter", Jul. 1, 2002, ISO.*

International Standard ISO 6272-2, "Paints and varnishes—Rapid-deformation (impact resistance tests—Part 2: Falling-weight test, small-area indenter", Jul. 1, 2002, ISO.*

* cited by examiner

SCROLL FLUID MACHINE WITH A COATING LAYER

BACKGROUND OF THE INVENTION

The present invention relates to a scroll fluid machine suitable for use as an air compressor, a vacuum pump, etc. by way of example.

In general, a scroll fluid machine includes a fixed scroll and an orbiting scroll which is positioned to face the fixed scroll. The fixed scroll and the orbiting scroll each have a disk-shaped end plate and a wrap portion which projects axially from the end plate. The wrap portion is wound spirally from the radially inner side toward the radially outer side of the end plate. Thus, the fixed scroll and the orbiting scroll define a plurality of compression chambers by overlapping of their wrap portions.

In the scroll fluid machine, the orbiting scroll is driven by a driveshaft to perform an orbiting motion with respect to the fixed scroll with a predetermined orbiting radius, thereby sucking a fluid, e.g. a gas, from a suction opening provided in a radially outer part of the fixed scroll, and successively compressing the fluid in the compression chambers. Finally, the compressed fluid is discharged to the outside from a discharge opening provided in a radially inner part of the fixed scroll.

There is known a scroll fluid machine having a plurality of projections on peripheral surfaces of wrap portions to reduce a gap between the wrap portions, and thereby increase a degree of hermeticity of compression chambers, and improve a compression efficiency, as described, for example, in Japanese Patent Application Unexamined Publication (KOKAI) No. 2005-76517. The plurality of projections are spaced apart in a winding direction (spiral direction), on the peripheral surfaces of the wrap portions, so as to project in a radial direction, relative to their surrounding area, from the peripheral surfaces of the wrap portions.

It is to be noted that the above-described scroll fluid machine of the related art has a plurality of axially extending projections on the peripheral surfaces of the wrap portions to reduce an amount of compressed fluid leaking through mutually opposing wrap portions, so as to increase a degree of hermeticity of the compression chambers. However, due to errors in dimensions, assembly, or the like of the compressor, the scroll fluid machine of the related art may suffer galling and so on when the projections make contact with the peripheral surface of the mating wrap portion. This leads to further power loss, more noise, and so on.

There is also known a structure that is provided with a soft resin film on a peripheral surface of a wrap portion to fit the resin film with the projections, thereby preventing galling and so on. In this case, however, if the resin film is too thick, the entire peripheral surface of the wrap portion makes contact with the resin film, which leads to further power loss, more noise, and so on. On the other hand, if the resin film is too thin, the projections do not make contact with the resin film, causing a problem of reducing the effect of the projections and increasing the degree of hermeticity of the compression chambers.

SUMMARY OF THE INVENTION

The present invention has been made in view of the above-described problems in the related art. An object of the present invention is to provide a scroll fluid machine that is capable of preventing power loss and increasing the degree of hermeticity of the compression chambers.

The present invention provides a scroll fluid machine comprising:

a first scroll having a first wrap portion spirally wound on and projecting from a first end plate in an axial direction; and a second scroll positioned to face the first scroll and including a second wrap portion that projects from a second end plate in the axial direction, the second wrap portion being spirally wound to overlap the first wrap portion of the first scroll and define a plurality of compression chambers; wherein:

a first coating layer made of a coating material is continuously formed on at least either one of an inner peripheral surface or an outer peripheral surface of the first wrap portion of the first scroll; and an inner peripheral surface or an outer peripheral surface of the second wrap portion of the second scroll that faces the first coating layer is formed to be a smooth surface;

and wherein the first coating layer comprises:

a plurality of first contact portions of a projecting shape, that have a layer thickness adjusted by contact with the smooth surface, are spaced apart from each other in a winding direction, and extend in the axial direction; and a first non-contact portion that is positioned between the contact portions adjacent to each other and never make contact with the smooth surface.

Further, the present invention provides a scroll fluid machine comprising:

a casing in which a driveshaft is adapted to rotate;

a fixed scroll fixed to the casing and provided with a first wrap portion that is spirally wound on and projects from a first end plate in an axial direction; and an orbiting scroll adapted to perform an orbiting motion according to rotation of the driveshaft, positioned to face the fixed scroll, and provided with a second wrap portion that projects from a second end plate in the axial direction, the second wrap portion being spirally wound to overlap the first wrap portion of the fixed scroll and define a plurality of compression chambers; wherein:

a plurality of first and second projections, which are spaced apart from each other in a winding direction and extend in the axial direction, are formed on outer peripheral surfaces of the first wrap portion of the fixed scroll and the second wrap portion of the orbiting scroll, respectively;

inner peripheral surfaces of the first wrap portion of the fixed scroll and the second wrap portion of the orbiting scroll are formed to be smooth surfaces; and a fixed-scroll outer peripheral coating layer made of a coating material is formed on the outer peripheral surface of the first wrap portion of the fixed scroll continuously in a circumferential direction, and wherein the fixed-scroll outer peripheral coating layer comprises:

projection surface contact portions that are positioned on the first projections and have a layer thickness adjusted by contact with the inner peripheral surface of the second wrap portion of the orbiting scroll; and projection surface non-contact portions that are positioned between the projections adjacent to each other and never make contact with the inner peripheral surface of the second wrap portion of the orbiting scroll.

Further, the present invention provides a scroll fluid machine comprising:

a casing in which a driveshaft is adapted to rotate;

a fixed scroll fixed to the casing and provided with a first wrap portion that is spirally wound on and projects from a first end plate in an axial direction; and an orbiting scroll adapted to perform an orbiting motion according to rotation of the driveshaft, positioned to face the fixed scroll, and provided with a second wrap portion that projects from a second end plate in the axial direction, the second wrap portion being spirally wound to overlap the first wrap portion of the fixed scroll and define a plurality of compression chambers; wherein a plurality of first and second projections, which are spaced apart from each other in a winding direction and extend in the axial direction, are formed on outer peripheral surfaces of the first wrap portion of the fixed scroll and the second wrap portion of the orbiting scroll, respectively;

inner peripheral surfaces of the first wrap portion of the fixed scroll and the second wrap portion of the orbiting scroll are formed to be smooth surfaces;

a fixed-scroll outer peripheral coating layer made of a coating material is formed on the outer peripheral surface of the first wrap portion of the fixed scroll continuously in a circumferential direction; and a fixed-scroll inner peripheral coating layer made of a coating material is formed on the inner peripheral surface of the first wrap portion of the fixed scroll continuously in the circumferential direction, and wherein the fixed-scroll outer peripheral coating layer comprises:

projection surface contact portions that are positioned on the first projections and have a layer thickness adjusted by contact with the inner peripheral surface of the second wrap portion of the orbiting scroll; and projection surface non-contact portions that are positioned between the projections adjacent to each other and never make contact with the inner peripheral surface of the second wrap portion of the orbiting scroll, and wherein the fixed-scroll inner peripheral coating layer comprises:

smooth surface contact portions that have a layer thickness adjusted by contact with the second projections formed on the outer peripheral surface of the second wrap portion of the orbiting scroll; and smooth surface non-contact portions that never make contact with the outer peripheral surface of the second wrap portion of the orbiting scroll.

DETAILED DESCRIPTION OF THE PREFERRED EMBODIMENTS

Figure 1:
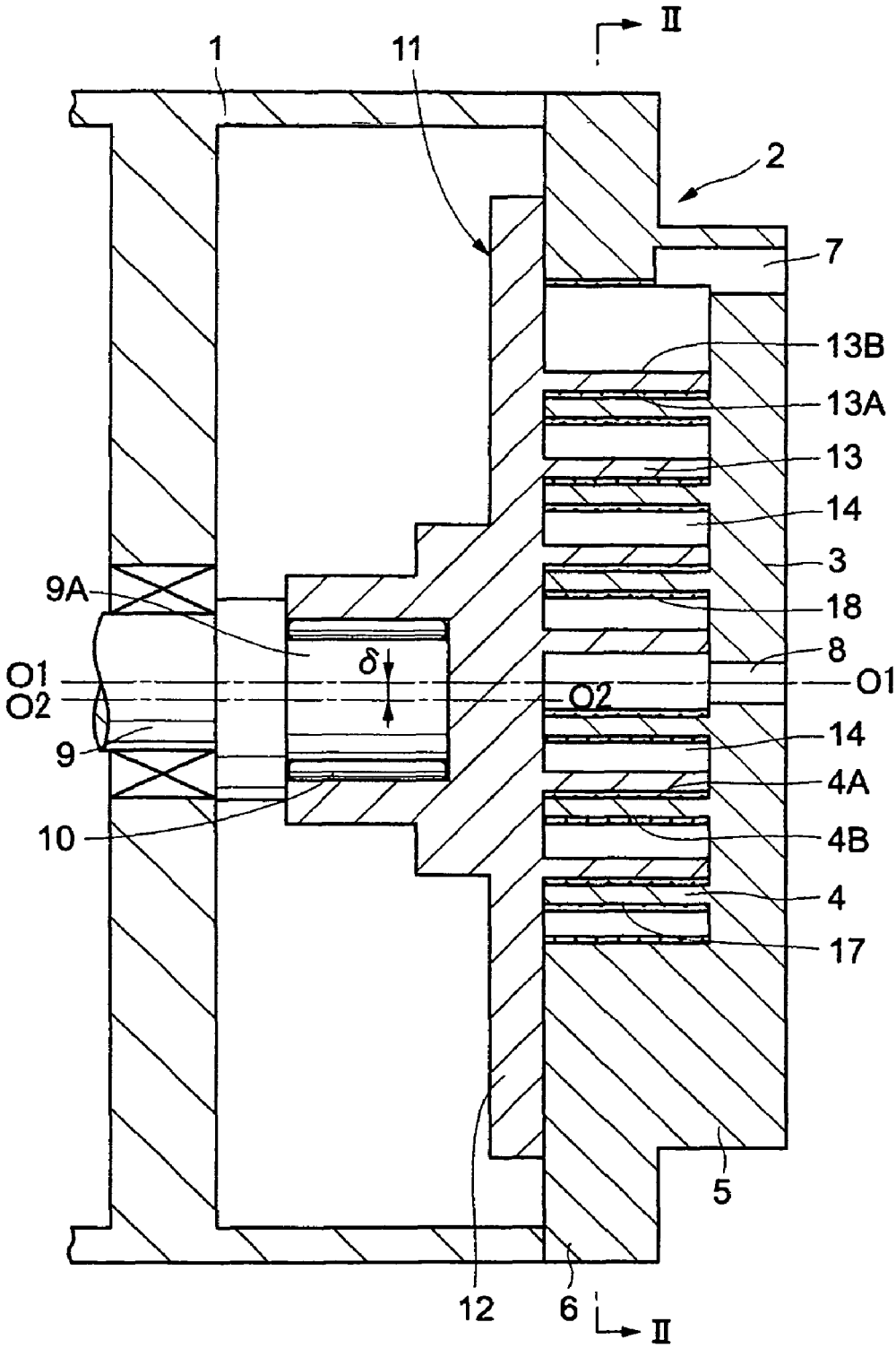
FIG. 1 is a longitudinal cross sectional view of a scroll air compressor according to one embodiment of the present invention.

Below, scroll fluid machines according to embodiments of the present invention are described in detail with reference to accompanying figures.

FIGS. 1 to 7 show one embodiment of the present invention. This embodiment is described below by way of an example of a scroll air compressor.

In the figures, reference numeral 1 denotes a casing of the scroll air compressor. The casing 1 has a cylindrical shape and supports a driveshaft 9 (described later) rotatably therein.

Reference numeral 2 denotes a fixed scroll attached to an end of the casing 1. The fixed scroll 2 is made of metal including, for example, aluminum, its alloy, or the like. A surface of the fixed scroll 2 can be subjected to alumite treatment. The fixed scroll 2 mainly comprises: an end plate 3 having substantially a disk shape and disposed coaxially with an axial line O1-O1 of the driveshaft 9 (described later); a spiral wrap portion 4 formed to project from a surface of the end plate 3; a cylindrical portion 5 projecting in an axial direction from the outer peripheral edge of the end plate 3 so as to surround the wrap portion 4; and a flange portion 6 extending radially outward from the cylindrical portion 5.

The fixed scroll 2 has a suction opening 7 formed on a radially outer side of the end plate 3 to suck air into compression chambers 14 (described later) therethrough. The end plate 3 is provided, at a center thereof, with a discharge opening 8 for discharging air compressed in the compression chambers 14 to the outside.

Figure 2:
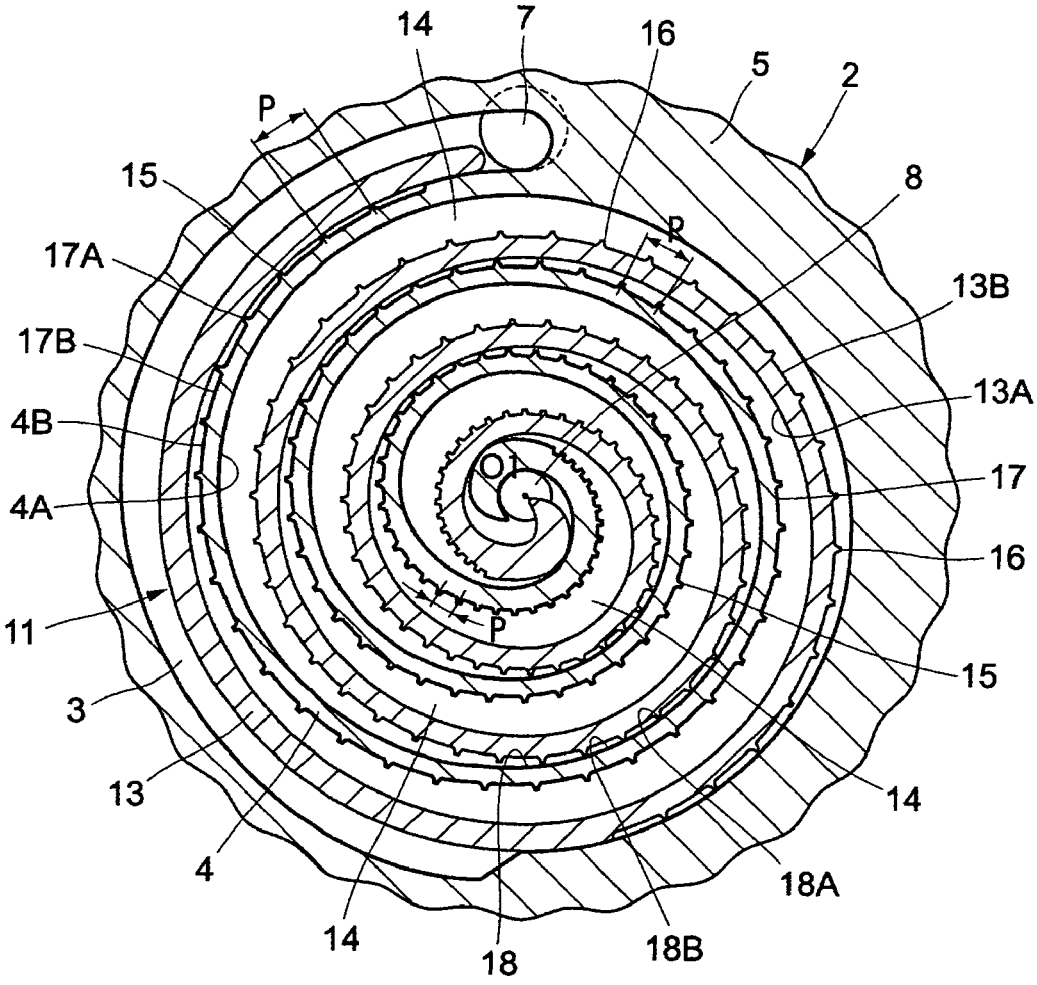
FIG. 2 is a transverse cross sectional view of the scroll air compressor as viewed in the direction indicated by the arrow II-II of FIG. 1.

As shown in FIG. 2, the wrap portion 4 is formed, using a cutting tool such as an end mill, in a spiral shape with n turns in which the radially inner end (an inner side in a radial direction) of the wrap portion 4 is a spiral starting end, and the radially outer end (an outer side in the radial direction) of the wrap portion 4 is a spiral terminating end. In this case, radial gaps between positions of the wrap portion 4, that is, between the first turn and the second turn, between the second turn and the third turn . . . , and between the (n−1)th turn and the nth, are set to a radial gap dimension T shown in FIG. 3. Specifically, the (n−1)th turn of an outer peripheral surface 4B of the wrap portion 4 and the nth turn of an inner peripheral surface 4A of the wrap portion 4 are separated by the radial gap dimension T, for example, about 18 mm.

Further, the inner peripheral surface 4A of the wrap portion 4 is concaved along the winding direction to form a smooth surface without recesses or projections. On the other hand, the outer peripheral surface 4B of the wrap portion 4 is provided with a plurality of fixed outer peripheral projections 15 (described later).

Reference numeral 9 denotes a driveshaft rotatably disposed in the casing 1. The driveshaft 9 has an axial line O1-O1 (axial center O1) which is a center of rotation. An end of the crankshaft 9 is formed to be a crank 9A having an axial line O2-O2 (axial center O2) that is eccentric with respect to the axial line O1-O1 by an orbiting radius δ. An orbiting scroll 11 (described later) is rotatably attached via an orbiting bearing 10 to the crank 9A.

Reference numeral 11 denotes the orbiting scroll that is provided on the driveshaft 9 to face the fixed scroll 2. The orbiting scroll 11 is made of, for example, the same metal as that of the fixed scroll 2. Further, the orbiting scroll 11 mainly comprises: an end plate 12 formed to have the shape of a disk coaxial with the axial line O2-O2 of the crank 9A; and a spiral wrap portion 13 projecting in the axial direction from a surface of the end plate 12.

As shown in FIG. 2, the wrap portion 13 has a spiral shape in which the radially inner end is a spiral starting end and the radially outer end is a spiral terminating end. The wrap portion 13 has a constant radial gap dimension that is the same as the dimension T of the wrap portion 4. The inner peripheral surface 13A of the wrap portion 13 is concaved along the winding direction to be a smooth surface without recesses or projections. On the other hand, the outer peripheral surface 13B of the wrap portion 13 is provided with a plurality of orbiting outer peripheral projections 16 (described later). The wrap portion 13 is disposed to overlap the wrap portion 4 of the fixed scroll 2 with an offset angle of 180 degrees, for example, such that a plurality of compression chambers 14 are defined between the wrap portions 4 and 13.

In the scroll air compressor, the crank 9A of the driveshaft 9 is made eccentric by the orbiting radius δ. In this way, when the driveshaft 9 is rotated, the orbiting scroll 11 is caused to revolve while it is prevented from spinning by a spin-preventing mechanism (not shown) or the like, so as to perform an orbiting motion with the orbiting radius δ with respect to the fixed scroll 2.

Therefore, in the air compressor, air sucked through the suction opening 7 into the compression chambers 14 on the outer peripheral side is successively compressed in each compression chamber 14, and the compressed air is discharged from the compression chamber 14 at the center (radially innermost side) through the discharge opening 8 to the outside. During this process, each compression chamber 14 is maintained in a highly hermetical condition by outer peripheral projections 15, 16 of the wrap portions 4, 13, coating layers 17, 18 (described later), and so on.

Figure 3:
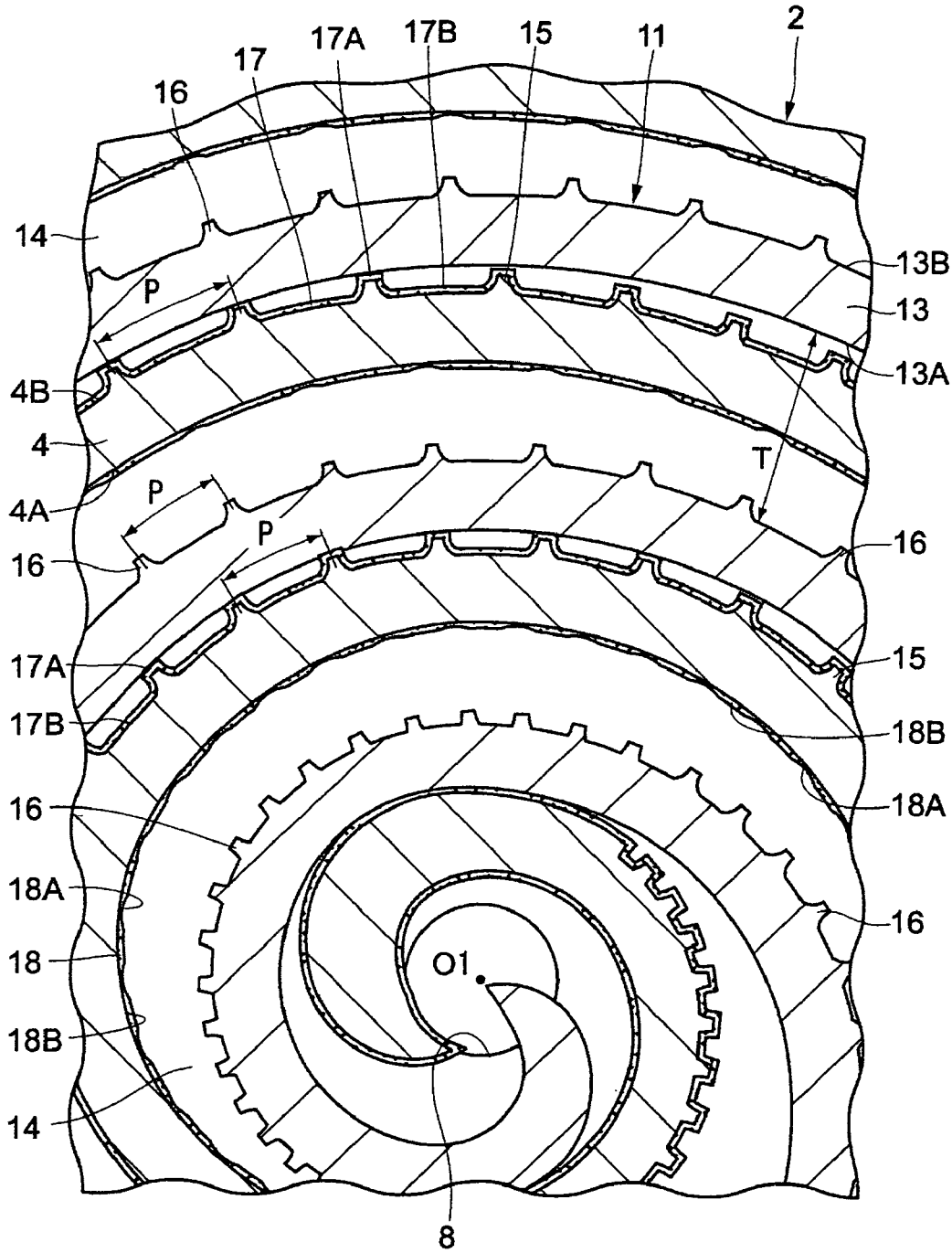
FIG. 3 is an enlarged transverse cross sectional view of the main parts of the wrap portion of the fixed scroll and the wrap portion of the orbiting scroll of FIG. 2.
Figure 4:
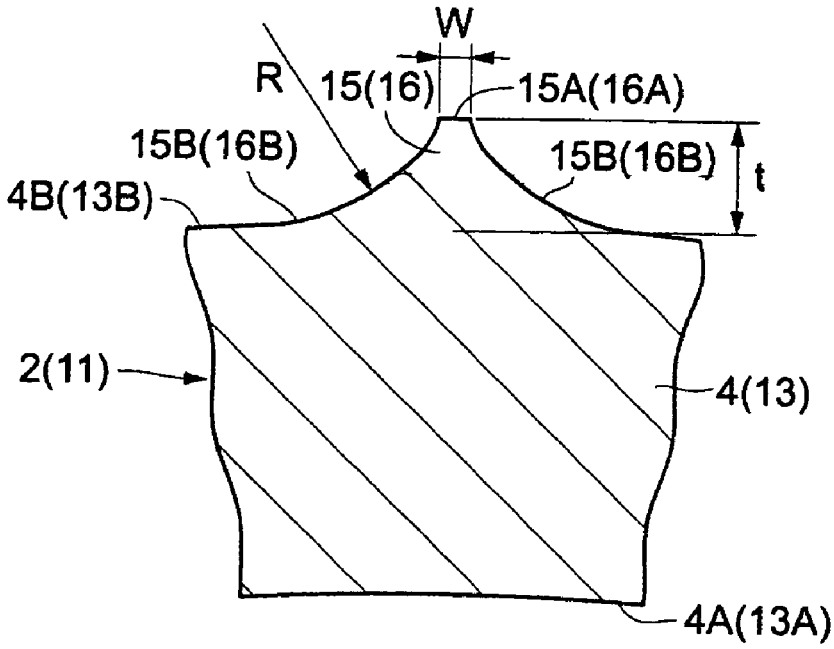
FIG. 4 is an enlarged transverse cross sectional view of the main parts of an outer peripheral projection of FIG. 3.
Figure 5:
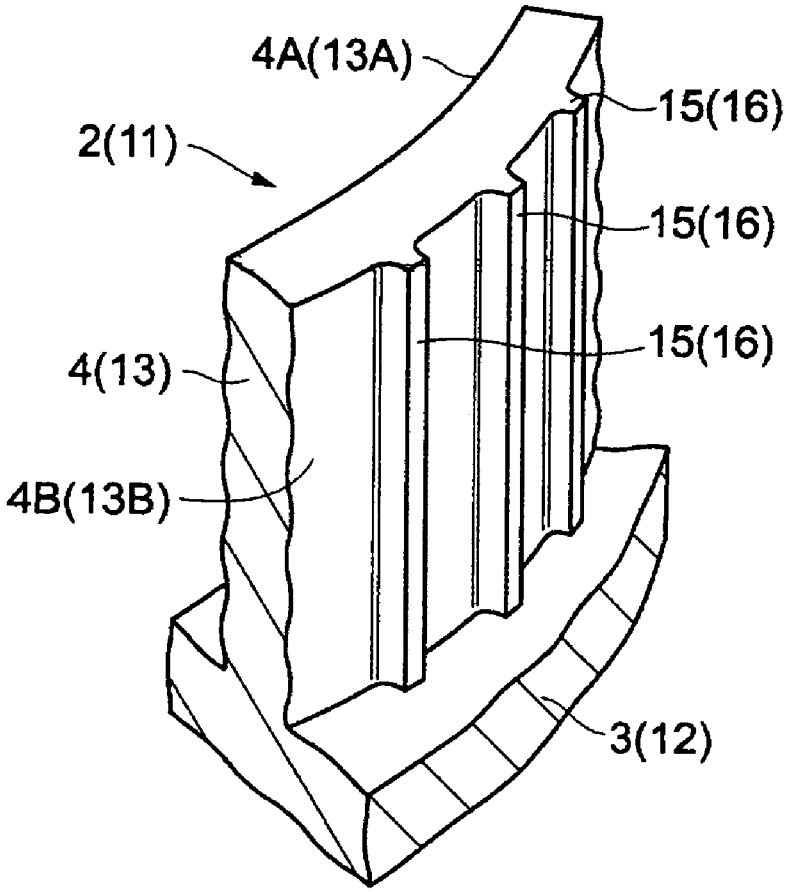
FIG. 5 is a partially-cutaway perspective view of a part of an end plate, a wrap portion, outer peripheral projections of the fixed scroll.

Reference numeral 15 denotes a plurality of fixed outer peripheral projections formed on the outer peripheral surface 4B of the wrap portion 4 of the fixed scroll 2. As shown in FIGS. 3 to 5, each fixed outer peripheral projection 15 is formed, for example, in a substantially triangular shape in transverse cross section, so as to project radially outward from the outer peripheral surface 4B of the wrap portion 4 and extend in its axial direction.

When the orbiting scroll 11 performs an orbiting motion with respect to the fixed scroll 2, a part of the fixed outer peripheral projections 15 corresponding to the position and the inner peripheral surface 13A of the wrap portion 13 come closest to each other, so as to bring an outer peripheral coating layer 17 (described later) formed on the outer peripheral surface 4B of the wrap portion 4 into contact with the inner peripheral surface 13A of the wrap portion 13. In this way, a portion (contact portion), where the outer peripheral coating layer 17 of the wrap portion 4 and the inner peripheral surface 13A of the wrap portion 13 are in contact with each other, forms a trapping position for trapping air in each compression chamber 14. At the trapping position of each compression chamber 14, the fixed outer peripheral projections 15 reduce a gap between the outer peripheral surface 4B of the wrap portion 4 and the inner peripheral surface 13A of the wrap portion 13 to thereby enhance the degree of hermeticity of each compression chamber 14.

As shown in FIG. 3, the outer peripheral projections 15 are spaced apart from each other in the winding direction (direction of length) of the wrap portion 4. In this case, a pitch P between adjacent outer peripheral projections 15 in the winding direction is narrow (for example, about 3 mm) on the radially inner side of the wrap portion 4 and wide (for example, about 7 mm) on the radially outer side. As described above, by narrowing (reducing) the pitch P between the adjacent outer peripheral projections 15 toward the radially inner side, the degree of hermeticity of the compression chambers 14 can be enhanced even at a sharply curved position where a radius of curvature of the opposing wrap portion 13 is small.

When viewed in transverse cross section shown in FIG. 4, the fixed outer peripheral projection 15 comprises: an apex 15A positioned at a tip and having a narrow width; and concave surfaces 15B that form left and right skirting portions smoothly connecting the apex 15A and outer peripheral surface 4B of the wrap portion 4. In this case, the apex 15A has a narrow width W of, for example 0 to 2 mm, preferably, about 0.1 to 0.3 mm.

Figure 6:
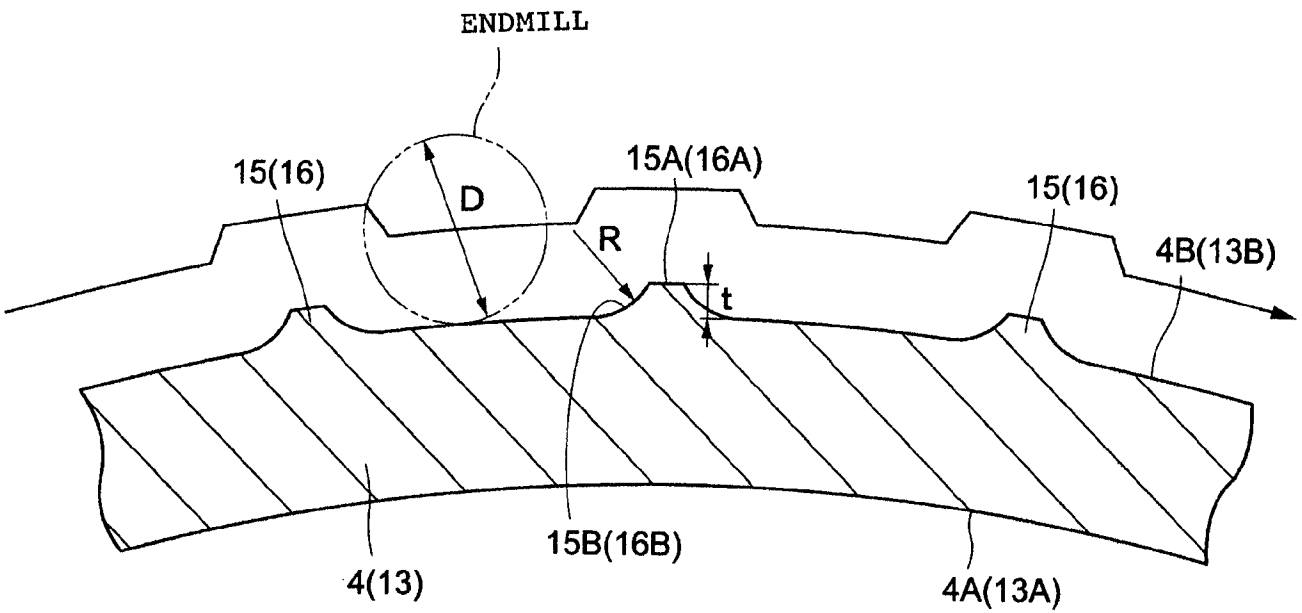
FIG. 6 is a transverse cross sectional view showing that a wrap portion is machined, using an end mill.

The fixed outer peripheral projections 15 have a projecting dimension t of, for example, about 40 μm and project radially outward from the outer peripheral surface 4B of the wrap portion 4. As shown in FIG. 6, the diameter D of an end mill for forming the wrap portion 4 is set to a value smaller than the radial gap dimension T of the wrap portion 4 minus the projecting dimension t of the fixed outer peripheral projection 15 ($D<(T-t)$). Therefore, the radius R of curvature of each concave surface 15B is set to a value larger than the radius of the end mill (D/2) ($R \geqq (D/2)$). In view of productivity and machinability, the radius R of curvature of each concave surface 15B is preferably set to a value larger than the radius (D/2) of the end mill.

Reference numeral 16 denotes a plurality of orbiting outer peripheral projections formed on the outer peripheral surface 13B of the wrap portion 13 of the orbiting scroll 11. At a trapping position of each compression chamber 14, the orbiting outer peripheral projections 16 make contact with an inner peripheral coating layer 18 (described later) formed on the inner peripheral surface 4A of the wrap portion 4 of the fixed scroll 2, thereby reducing a gap between the inner peripheral surface 4A of the wrap portion 4 and the outer peripheral surface 13B of the wrap portion 13.

Substantially similar to the fixed outer peripheral projections 15, the orbiting outer peripheral projections 16 have, for example, a substantially triangular shape in transverse cross section and are spaced apart by a non-constant pitch P in the winding direction of the wrap portion 13. Further, the orbiting outer peripheral projections 16 each have an apex 16A and concave surfaces 16B in a shape and dimensions (projecting dimension t, width W, radius of curvature R, and so on) substantially similar to those of the fixed outer peripheral projections 15. A pitch P between adjacent outer peripheral projections 16 in the winding direction is narrow on the radially inner side of the wrap portion 13 and wide on the radially outer side.

The outer peripheral projections 15, 16 are formed over the entire lengths of the wrap portions 4 and 13 in their winding direction. Alternatively, the outer peripheral projections 15, 16 can be formed, for example, on the outer peripheral surfaces 4B, 13B of the entire spiral lengths of the wrap portions 4, 13 except portions ranging about half a turn from the spiral starting ends, which are innermost ends. The portions of the outer peripheral surfaces 4B, 13B of the wrap portions 4, 13 ranging about half a turn from the spiral starting ends have a smallest radius of curvature and have small size variations due to heat. Therefore, these portions are formed to have smooth surfaces, because the compression chambers 14 can be closed hermetically enough without outer peripheral projections 15, 16.

Alternatively, outer peripheral projections 15, 16 can be formed on the outer peripheral surfaces 4B, 13B of the entire spiral lengths of the wrap portions 4, 13 except portions ranging about one turn on the radially outer side. In this case, the portions of the wrap portions 4, 13 ranging about one turn on the radially outer side are formed to have inner peripheral surfaces 4A, 13A and outer peripheral surfaces 4B, 13B along involute curves. In this way, compression chambers 14 located at a compression starting position on the outermost side can be desirably kept sealed. Further, even if noise due to contact of the outer projections 15, 16 leaks through the suction opening 7, the noise can be reduced.

Reference numeral 17 denotes an outer peripheral coating layer formed on the outer peripheral surface 4B of the wrap portion 4 of the fixed scroll 2. As shown in FIGS. 1 to 3, the outer peripheral coating layer 17 is formed by applying a coating material to the outer peripheral surface 4B of the wrap portion 4 continuously in the winding direction. Since the fixed outer peripheral projections 15 are formed on the outer peripheral surface 4B of the wrap portion 4, portions of the outer peripheral coating layer 17 covering the outer peripheral projections 15 project radially outward. The coating material is applied by a method such as dipping, spraying.

A coating material of the outer peripheral coating layer 17 can be, for example, a material that is "softer than H" in scratch hardness (pencil method) defined by Japanese Industrial Standards K5600-5-4 (ISO/DIS 15184, Determination of film hardness by pencil test) and "does not crack or peel" in resistance to weight drop defined by Japanese Industrial Standards K5600-5-3 (ISO 6272, Falling-weight test). More specifically, the coating material can be, for example, an inorganic coating material with a binder that contains titanate or silicate glass and also with a solid lubricant that contains graphite, boron nitride, or molybdenum disulfide. It is to be noted that compression heat generated in the compression chambers 14 may heat the outer peripheral coating layer 17 to a high temperature. Therefore, preferably, the coating material should be a heat resistant material that satisfies the conditions of scratch hardness and resistance to weight drop even after the material has been heated for a long time.

Figure 7:
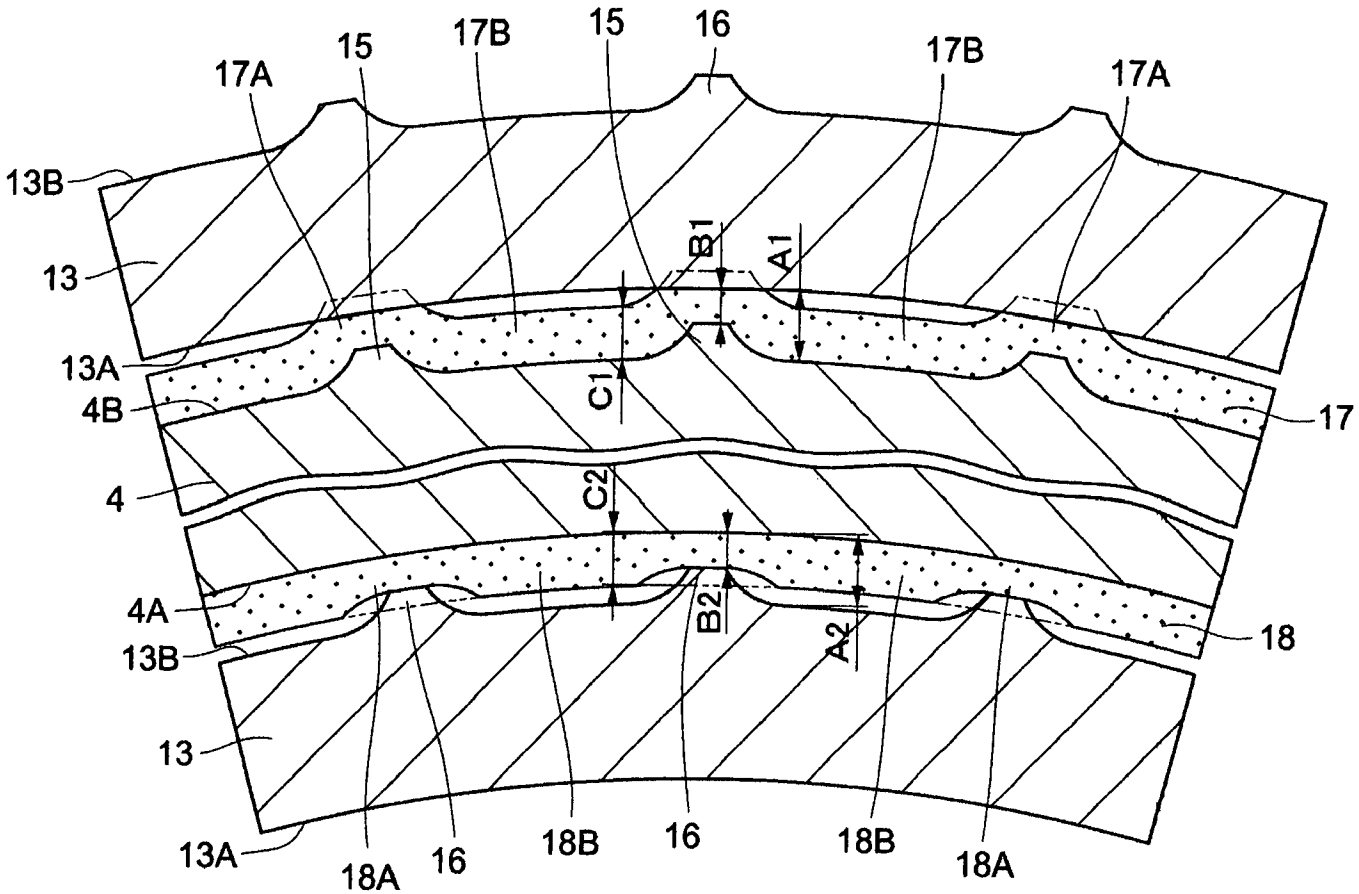
FIG. 7 is an enlarged transverse cross sectional view of the main parts, showing that the wrap portion of the fixed scroll according to said one embodiment is closest to the inner peripheral surface and outer peripheral surface of the wrap portion of the orbiting scroll.

A1 and B1 respectively denote a separation between the outer peripheral surface 4B of the wrap portion 4 and the inner peripheral surface 13A of the wrap portion 13 and a separation between the fixed outer peripheral projections 15 and the inner peripheral surface 13A of the wrap portion 13 at a closest position where the fixed outer peripheral projections 15 of the wrap portion 4 of the fixed scroll 2 come closest to the inner peripheral surface 13A of the wrap portion 13 of the orbiting scroll 11. As shown in FIG. 7, the thickness C1 of the outer peripheral coating layer 17 is set to satisfy a relationship represented by the equation (1) below. At positions of the tips of the fixed outer peripheral projections 15, the thickness C1 of the outer peripheral coating layer 17 corresponds to a film thickness indicated by broken lines of FIG. 7 before the thickness is adjusted by the inner peripheral surface 13A of the wrap portion 13.

$$B1<C1<A1 \qquad \text{Equation (1)}$$

Specifically, when the separations A1 and B1 are set to about 80 μm and about 40 μm, respectively, the thickness C1 of the outer peripheral coating layer 17 is set to, for example, about 60 μm, which falls between the separations A1 and B1.

Portions of the outer peripheral coating layer 17 that correspond to the tips of the fixed outer peripheral projections 15 make contact with the inner peripheral surface 13A of the wrap portion 13 of the orbiting scroll 11. On the other hand, portions between adjacent fixed outer peripheral projections 15 do not make contact with the inner peripheral surface 13A of the wrap portion 13 of the orbiting scroll 11. Portions of the outer peripheral coating layer 17 that make contact with the inner peripheral surface 13A of the wrap portion 13 can be readily deformed to adjust a reduction in thickness, thereby fitting with the inner peripheral surface 13A of the wrap portion 13.

Therefore, the outer peripheral coating layer 17 comprises: projection surface contact portions 17A positioned on the fixed outer peripheral projections 15 and having a layer thickness that can be adjusted by contact with the inner peripheral surface 13A of the wrap portion 13 of the orbiting scroll 11; and projection surface non-contact portions 17B that are positioned between adjacent fixed outer peripheral projections 15 and never make contact with the inner peripheral surface 13A of the wrap portion 13 of the orbiting scroll 11.

Reference numeral 18 denotes an inner peripheral coating layer formed on the inner peripheral surface 4A of the wrap portion 4 of the fixed scroll 2. The inner peripheral coating layer 18 is formed by applying a coating material to the inner peripheral surface 4*a* of the wrap portion 4 continuously in the winding direction. In this way, the inner peripheral coating layer 18 is made smooth along the inner peripheral surface 4A of the wrap portion 4.

A coating material of the inner peripheral coating layer 18 is, for example, the same as that of the outer peripheral coating layer 17. Therefore, the coating material of the inner peripheral coating layer 18 is also "softer than H" in scratch hardness (pencil method) defined by Japanese Industrial Standards K5600-5-4 and "does not crack or peel" in resistance to weight drop defined by Japanese Industrial Standards K5600-5-3.

A2 and B2 respectively denote a separation between the outer peripheral surface 13B of the wrap portion 13 and the inner peripheral surface 4A of the wrap portion 4 and a separation between the orbiting outer peripheral projections 16 and the inner peripheral surface 4A of the wrap portion 4 at a closest position where the orbiting outer peripheral projections 16 of the wrap portion 13 of the orbiting scroll 11 come closest to the inner peripheral surface 4A of the wrap portion 4 of the fixed scroll 2. The thickness C2 of the inner peripheral coating layer 18 is set to satisfy the relationship represented by equation (2) below. It is to be noted that the thickness C2 of the inner peripheral coating layer 18 corresponds to a film thickness indicated by broken lines in FIG. 7 at portions of contact with the orbiting outer peripheral projections 16 before the film thickness is adjusted by the orbiting outer peripheral projections 16.

$$B2<C2<A2 \quad \text{Equation (2)}$$

Specifically, when the separations A2 and B2 are set to about 80 μm and about 40 μm, respectively, the thickness C2 of the inner peripheral coating layer 18 is set to, for example, about 60 μm.

In this way, the inner peripheral coating layer 18 makes contact with the orbiting outer peripheral projections 16 of the wrap portion 13 of the orbiting scroll 11 but does not make contact with the outer peripheral surface 13B of the wrap portion 13. The portions of the inner peripheral coating layer 18 that make contact with the orbiting outer peripheral projections 16 can be readily recessed to reduce the thickness, thereby fitting with the orbiting outer peripheral projections 16.

As a result, the inner peripheral coating layer 18 comprises: smooth surface contact portions 18A having a layer thickness that can be adjusted by contact with the orbiting outer peripheral projections 16 formed on the outer peripheral surface 13B of the wrap portion 13 of the orbiting scroll 11; and smooth surface non-contact portions 18B that never make contact with the outer peripheral surface 13B of the wrap portion 13 of the orbiting scroll 11.

Next, the thicknesses C1 and C2 of the coating layers 17 and 18 are described in detail.

Figure 8:
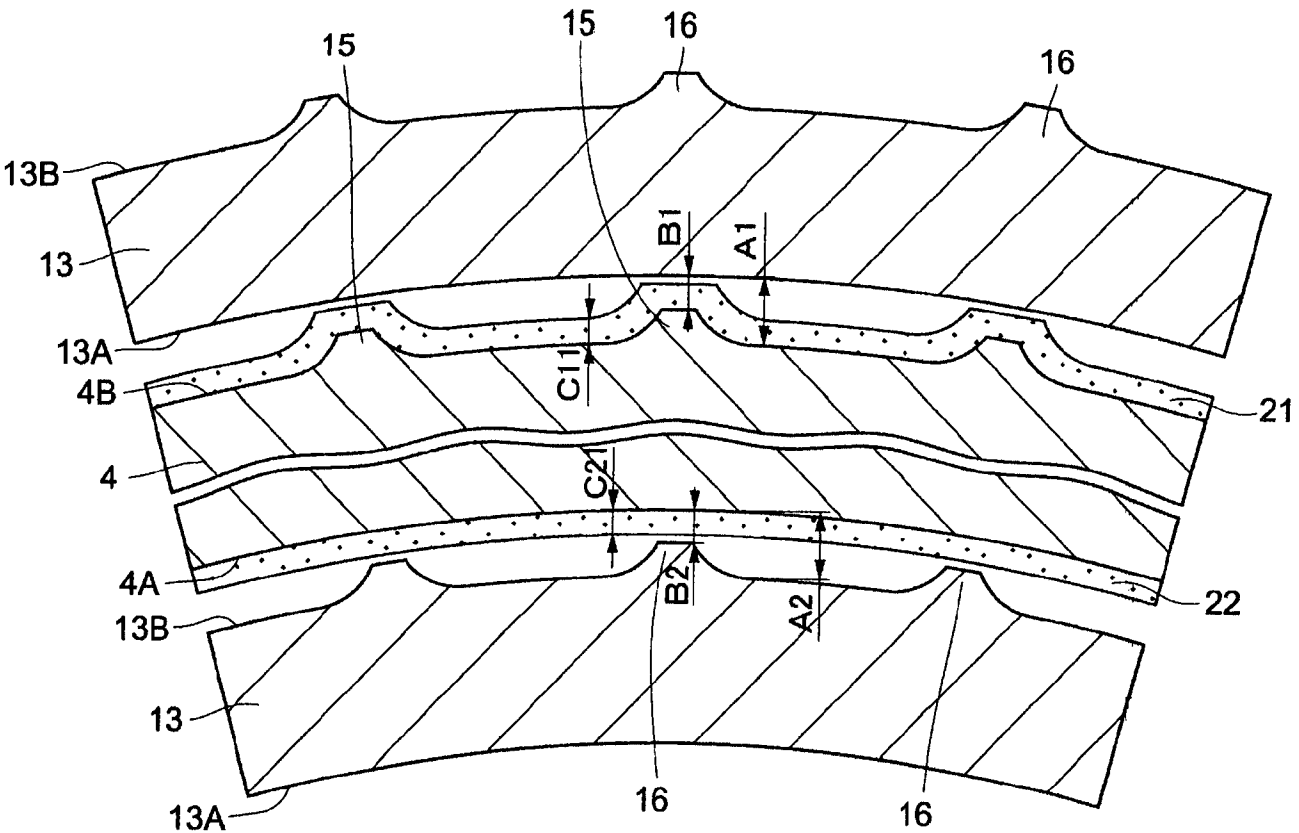
FIG. 8 is a transverse cross sectional view corresponding in position to that of FIG. 7, showing that a wrap portion of a fixed scroll according to a first comparative example is closest to an inner peripheral surface and an outer peripheral surface of a wrap portion of an orbiting scroll.

In a first comparative example shown in FIG. 8, the thickness C11 of the outer peripheral coating layer 21 is set to be smaller than the separation B1 between the fixed outer peripheral projections 15 and the inner peripheral surface 13A of the wrap portion 13 at the closest position. In the first comparative example, the thickness C21 of the inner peripheral coating layer 22 is also set to be smaller than the separation B2 between the orbiting outer peripheral projections 16 and the inner peripheral surface 4A of the wrap portion 4 at the closest position. In the first comparative example, the outer peripheral coating layer 21 never makes contact with the inner peripheral surface 13A of the wrap portion 13, and the inner peripheral contact layer 22 never makes contact with the outer peripheral surface 13B of the wrap portion 13, either. Therefore, there is a gap between the coating layers 21, 22 and the wrap portion 13. As a result, compressed air leaks through the gap, and compression efficiency tends to decrease.

Figure 9:
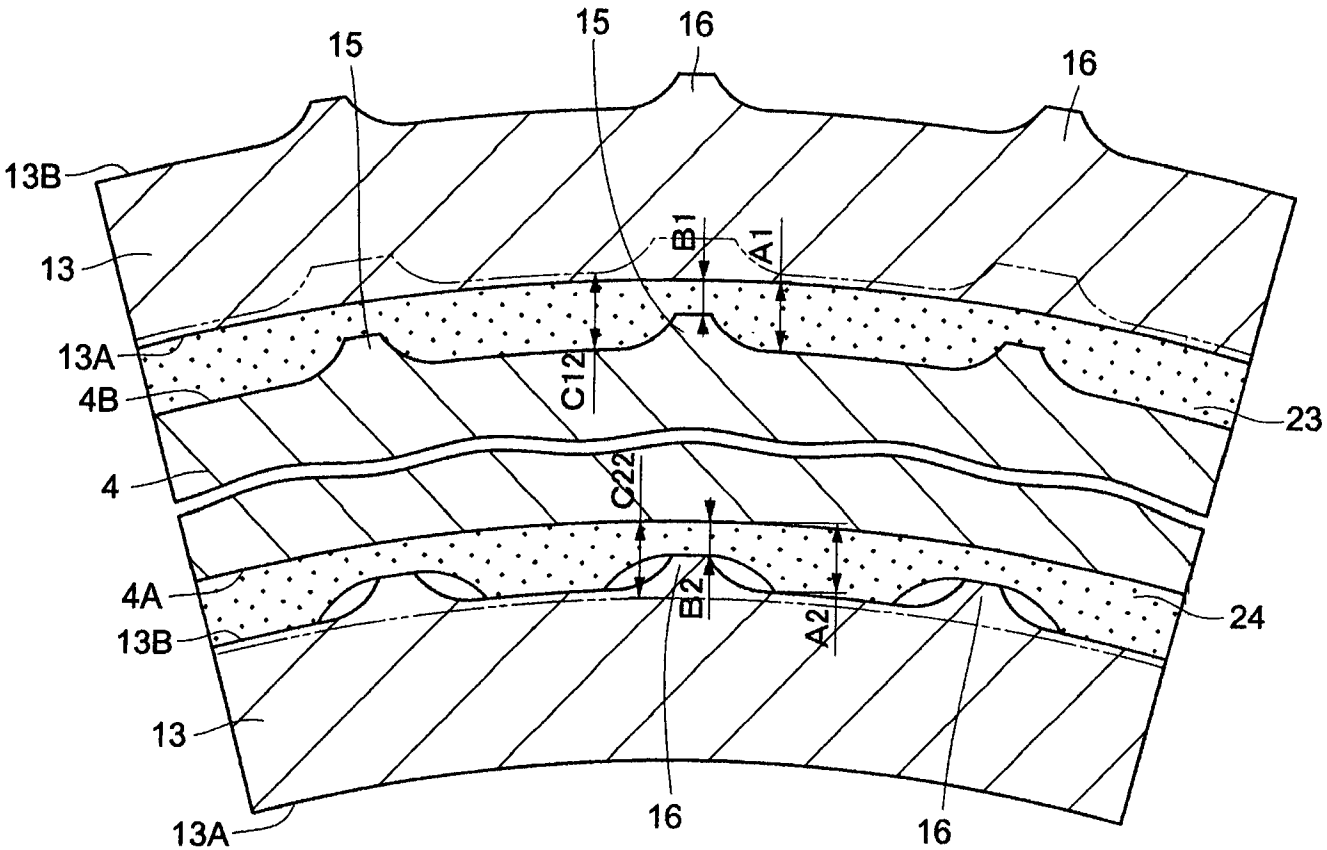
FIG. 9 is a transverse cross sectional view corresponding in position to that of FIG. 7, showing that a wrap portion of a fixed scroll according to a second comparative example is closest to an inner peripheral surface and an outer peripheral surface of a wrap portion of an orbiting scroll.

In a second comparative example shown in FIG. 9, the thickness C12 of the outer peripheral coating layer 23 is set to be larger than the separation A1 between the outer peripheral surface 4B of the wrap portion 4 and the inner peripheral surface 13A of the wrap portion 13 at the closest position. In the second comparative example, the thickness C22 of the inner peripheral coating layer 24 is also set to be larger than the separation A2 between the inner peripheral surface 4A of the wrap portion 4 and the outer peripheral surface 13B of the wrap portion 13 at the closest position. In the second comparative example, portions of the outer peripheral coating layer 23 positioned on the fixed outer peripheral projections 15 make contact with the inner peripheral surface 13A of the wrap portion 13. The portions between adjacent outer peripheral projections 15 also make contact with the inner peripheral surface 13A of the wrap portion 13. Similarly, the inner peripheral coating layer 24 also makes contact with the orbiting outer peripheral projections 16, and the portions between adjacent outer peripheral projections 16 also make contact with the outer peripheral surface 13B of the wrap portion 13. In this way, areas of contact between the coating layers 23, 24 and the wrap portion 13 increases, and power loss and noise also tend to increase.

In contrast, as shown in FIG. 7, this embodiment is characterized in that the thickness C1 of the outer peripheral coating layer 17 is set to be larger than the separation B1 between the fixed outer peripheral projections 15 and the inner peripheral surface 13A of the wrap portion 13 and smaller than the separation A1 between the outer peripheral surface 4B of the wrap portion 4 and the inner peripheral surface 13A of the wrap portion 13 at the closest position (B1<C1<A1).

Therefore, the outer peripheral coating layer 17 comprises; projection surface contract portions 17A that make contact with the inner peripheral surface 13A of the wrap portion 13; and projection surface non-contact portions 17B that never make contact with the inner peripheral surface 13A of the wrap portion 13. Since the projection surface contact portions 17A of the outer peripheral coating layer 17 make contact with the opposing inner peripheral surface 13A of the wrap portion 13 of the orbiting scroll 11, compressed air can be prevented from leaking by the projection surface contact portions 17A, and thus the degree of hermeticity of the compression chambers 14 can be enhanced, compared to the first comparative example. Further, since the projection surface non-contact portions 17B of the outer peripheral coating layer 17 never make contact with the wrap portion 13 of the orbiting scroll 11, areas of contact with the mating wrap portion 13 can be reduced, and thus power loss and noise can be reduced, compared to the second example.

Similarly, the thickness C2 of the inner-peripheral coating layer 18 is set to be larger than the separation B2 between the orbiting outer peripheral projections 16 and the inner peripheral surface 4A of the wrap portion 4 and smaller than the separation A2 between the inner peripheral surface 4*a* of the wrap portion 4 and the outer peripheral surface 13A of the wrap portion 13 at the closest position (B2<C2<A2). Therefore, like the outer peripheral coating layer 17, the inner peripheral coating layer 18 also comprises smooth surface contact portions 18A and smooth surface non-contact portions 18B. As a result, the degree of hermeticity of the compression chambers 14 can be enhanced, and power loss and so on can be reduced.

Next, the coating material of the coating layers 17, 18 is described in detail. Samples 1 to 6 listed in Table 1 below as the coating material are tested in resistance to weight drop, running-in, and scratch hardness.

TABLE 1

| Sample No. | Solid lubricant | Binder | JISK5600-5-3 resistance to weight drop: initial | After heating (270° C., 0.7 Mpa 3000 h) | result | Running-in | JISK5600-5-4 Scratch hardness | Total evaluation |
|---|---|---|---|---|---|---|---|---|
| 1 | Graphite | Titanate | ○ | ○ | ○ | ○ | 6B or lower | ○ |
| 2 | Graphite Molybdenum disulfide | Titanate | ○ | ○ | ○ | ○ | 6B or lower | ○ |

TABLE 1-continued

| Sample No. | Solid lubricant | Binder | JISK5600-5-3 resistance to weight drop initial | After heating (270° C., 0.7 Mpa 3000 h) | result | Runnig-in | JISK5600-5-4 Scratch hardness | Total evaluation |
|---|---|---|---|---|---|---|---|---|
| 3 | Molybdenum disulfide | Titanate | ○ | X cracked and peeled at 1500 h | Δ | ○ | 6B or lower | Δ |
| 4 | Boron nitride Tungsten disulfide | Silicate glass | ○ | ○ discolored | ○ | ○ | F | ○ |
| 5 | Graphite | Silicate glass | ○ | ○ | ○ | X | H | X |
| 6 | Graphite Molybdenum disulfide | Polyamide imide | ○ | X cracked and peeled at 500 h | Δ | X | 3H or more | X |

Sample 1: Sumico Lubricant Co., Ltd., dry coat 6500 (Sb-free)
Sample 2: STT Co, Ltd., Solvest 300 (+)
Sample 3: Dow Corning Torey, Molykote D-321R
Sample 4: Parker Kako Co., Ltd., Defric coat MC-52WB
Sample 5: Toyo Drilube, Co. Ltd., Drilube A
Sample 6: Kawamura Research Laboratory, Defric Coat HMB-2G In resistance to weight drop, conditions after heating were evaluated in addition to initial conditions of assemblage into a compressor. In resistance to weight drop after heating, sample pieces were formed by applying a coating material to plates made of the same material as the wrap portion 4, were then placed in the atmosphere at 270° C. and 0.7 MPa for 500 hours, 1500 hours, or 3000 hours, and were evaluated after the respective hours by conducting tests for resistance to weight drop defined by JIS K5600-5-3. Running-in was evaluated by amplitude of vibrations generated in the compressor until the coating material (coating layers 17, 18), which had been applied to the wrap portion 4 of the fixed scroll 2, fit with the wrap portion 13 of the orbiting scroll 11. Samples 1 to 6 include components that had been subjected to heat treatment or the like after applying them to the wrap portion 4, so as to improve adhesiveness and sealability of the coating material in the initial conditions.

The results in Table 1 show that, when Sample 1 (dry coat 6500 (Sb-free) made by Sumico Lubricant Co., Ltd.) was used, resistance to weight drop in the initial conditions of application of the coating material was good without cracking or peeling. In resistance to weight drop after 3000 hours of heating, heat resistance was also good without cracking or peeling. Initial running-in was also good without any large vibrations. At this stage, scratch hardness of sample 1 was 6 B or below, which is softer than H. Therefore, we found that sample 1 is excellent in adhesiveness to the wrap portion 4 and is heat resistant, is easy to fit with the mating wrap portion 13, and is suitable for use in the coating layers 17, 18.

When sample 2 (Solvest 300 (+) made by STT Co, Ltd.) was used, resistance to weight drop in the initial conditions was good without cracking or peeling. In resistance to weight drop after 3000 hours of heating, heat resistance was also good without cracking or peeling. Initial running-in was good without any large vibrations. Scratch hardness of sample 2 was 6 B or lower. Therefore, we found that sample 2 is also excellent in adhesiveness to the wrap portion 4 and is heat resistant, is easy to fit with the mating wrap portion 13, and is suitable for use in the coating layers 17, 18.

When sample 3 (Molykote D-321R made by Dow Corning Torey) was used, resistance to weight drop in the initial conditions was good and no cracking or peeling occurred. In resistance to weight drop after heating, we found that, in the test after 1500 hours of heating, cracking and peeling occurred, therefore, heat resistance was not good. Initial running-in was good without any large vibrations. At this stage, scratch hardness of sample 3 was 6 B or lower, which is softer than H. Therefore, sample 3 can readily fit with the mating wrap portion 13. However, despite the satisfactory resistance to weight drop in the initial conditions, sample 3 is not good in heat resistance; therefore, it is difficult to use sample 3 for a long time under conditions of a high temperature and a large pressure. Therefore, we found that sample 3 is not suitable for use in the coating layers 17, 18.

However, if heating conditions (temperature, pressure) are eased, it is possible that durability of sample 3 is also ensured for a long time. Therefore, it is considered that sample 3 can be used for the coating layers 17, 18 of the compressor that has a low discharge pressure and a low temperature (for example, about 150° C.) in the compression chambers 14.

When sample 4 (Defric coat MC-52WB made by Parker Kako Co., Ltd.) was used, resistance to weight drop in the initial conditions was good without cracking or peeling. In resistance to weight drop after 3000 hours of heating, heat resistance was good and no cracking or peeling occurred. Further, initial running-in was also good without any large vibrations. At this stage, scratch hardness of sample 4 was F, which is softer than H. Therefore, we found that sample 4 is excellent in adhesiveness to the wrap portion 4 and is heat resistant, easy to fit with the mating wrap portion 13, and is suitable for use in the coating layers 17, 18.

When sample 5 (Drilube A by Toyo Drilube, Co. Ltd.) was used, resistance to weight drop in the initial conditions was good and no cracking or peeling occurred. In resistance to weight drop after 3000 hours of heating, heat resistance was good and no cracking or peeling occurred. However, we found that in the initial running-in, large vibrations occurred and that it was difficult to fit. At this time, scratch hardness of sample 5 was H. Therefore, sample 5 is excellent in adhesiveness to the wrap portion 4 and is heat resistant. However, sample 5 is not good in initial running-in; therefore, large vibrations occur at the beginning of an operation of the compressor, and the coating material wears off over a long period of time. Therefore, we found that sample 5 is not suitable for use in the coating layers 17, 18.

When sample 6 (Defric Coat HMB-2G made by Kawamura Research Laboratory) was used, resistance to weight drop in the initial conditions was good and no cracking or peeling occurred. In resistance to weight drop after heating, however, cracking and peeling occurred in a test after 500 hours of heating; therefore, we found, heat resistance was not good. Further, we found that in the initial running-in, large vibrations occurred, and it was difficult to fit. At this time, scratch hardness of sample 6 was 3 H or more, which is harder than H. Although sample 6 is initially adhesive to the wrap portion 4, its heat resistance is not good. Therefore, sample 6 has a problem of short durability under conditions of a high temperature and a high pressure. Further, the initial running-in of sample 6 is not good; therefore, large vibrations occur at the beginning of an operation of the compressor, and the coating material wears off over a long time. Therefore, we found that sample 6 was not suitable for use in the coating layers 17, 18.

From the above result, we found that a suitable material for use in the coating layers 17, 18 is one which is "softer than H" in scratch hardness (pencil method) defined by Japanese Industrial Standards K5600-5-4 and "does not crack or peel" in resistance to weight drop defined by Japanese Industrial Standards K5600-5-3. We also found that to satisfy these conditions of scratch hardness and resistance to weight drop, it is preferable to use an inorganic coating material with a binder that includes titanate or silicate glass and with a solid lubricant that includes graphite, boron nitride, or molybdenum disulfide.

So far, the structure of the scroll air compressor according to this embodiment has been described. Next, an operation of the scroll air compressor will be described.

When the driveshaft 9 is rotated by a drive source (not shown) such as an electric motor, the orbiting scroll 11 performs an orbiting motion with an orbiting radius δ around the axial line O1-O1 of the driveshaft 9, while spinning is prevented by the spin-preventing mechanism, thereby continuously reducing the compression chambers 14 defined between the wrap portion 4 of the fixed scroll 2 and the wrap portion 13 of the orbiting scroll 11. This enables air sucked through the suction opening 7 of the fixed scroll 2 to be gradually compressed in each compression chamber 14, thereby forming compressed air which is subsequently discharged through the discharge opening 8 of the fixed scroll 2 to an external tank (not shown).

When the orbiting scroll 11 performs an orbiting motion with respect to the fixed scroll 2, the projection surface contact portions 17A of the outer peripheral coating layer 17 makes contact with the inner peripheral surface 13A of the wrap portion 13 of the orbiting scroll 11. At the same time, the smooth surface contact portions 18A of the inner peripheral coating layer 18 make contact with the outer peripheral projections 16 of the wrap portion 13 of the orbiting scroll 11. Therefore, the contact portions of the coating layers 17, 18 that make contact with the orbiting scroll 11 serve as trapping positions for trapping air in the compression chambers 14.

At the trapping position of each compression chamber 14, the contact portions 17A of the outer peripheral coating layer 17 reduce a gap between the outer peripheral surface 4B of the wrap portion 4 and the inner peripheral surface 13*a* of the wrap portion 13. At the trapping position of each compression chamber 14, the contact portions 18*a* of the inner peripheral coating layer 18 reduce a gap between the outer peripheral surface 13B of the wrap portion 13 and the inner peripheral surface 4A of the wrap portion 4. This enables the coating layers 17, 18 to enhance the degree of hermeticity of each compression chamber 14.

Since, in this embodiment, the outer peripheral surface 4B of the wrap portion 4 of the fixed scroll 2 is provided thereon with the outer peripheral coating layer 17 having the projection surface contact portions 17A and projection surface non-contact portions 17B, the projection surface contact portions 17A of the outer peripheral coating layer 17 make contact with the opposing inner peripheral surface 13A of the wrap portion 13 of the orbiting scroll 11. Therefore, compared to a case in which the outer peripheral coating layer 17 does not make contact with the inner peripheral surface 13A of the wrap portion 13, compressed air can be prevented from leaking by the projection surface contact portions 17A, so as to enhance the degree of hermeticity of the compression chambers 14. Since the projection surface non-contact portions 17B of the outer peripheral coating layer 17 never make contact with the wrap portion 13 of the orbiting scroll 11, areas of contact with the mating wrap portion 13 can be reduced, and therefore, power loss and noise can be also reduced, compared to a case without the projection surface non-contact portions 17B.

In particular, since the projection surface contact portions 17A of the outer peripheral coating layer 17 are formed on the outer peripheral projections 15 of the wrap portion 4, the projection surface contact portions 17*a* can be formed in a projecting shape conforming to the outer peripheral projections 15 of the wrap portion 4. In this way, the projection surface contact portions 17A can be readily squashed or made to wear off when making contact with the inner peripheral surface 13A of the wrap portion 13 of the orbiting scroll 11. As a result, the projection surface contact portions 17A can be fitted with the mating inner peripheral surface 13*a* of the wrap portion 13, before making contact a large number of times. In this way, power loss can be reduced, and damage, noise, galling, and so on can be prevented, resulting in improved durability and reliability.

The outer peripheral surface 4B of the wrap portion 4 of the fixed scroll 2 is provided with a plurality of outer peripheral projections 15 that are spaced apart from each other in the winding direction and extending in the axial direction. In this way, by forming the outer peripheral coating layer 17 on the outer peripheral surface 4B of the wrap portion 4 of the fixed scroll 2, the projection surface contact portions 17A can be formed on the outer peripheral projections 15 of the wrap portion 4, so as to project toward the wrap portion 13 of the orbiting scroll 11. At the same time, the projection surface non-contact portions 17B can be formed between adjacent projections.

On the other hand, since the inner peripheral surface 4A of the wrap portion 4 of the fixed scroll 2 is provided thereon with the inner peripheral coating layer 18 having the smooth surface contact portions 18A and smooth surface non-contact portions 18B, the smooth surface contact portions 18A of the inner peripheral coating layer 18A make contact with the outer peripheral projections 16 of the wrap portion 13 of the orbiting scroll 11. In this way, compressed air can be prevented from leaking by the smooth surface contact portions 18A, so as to enhance the degree of hermeticity of the compression chambers 14. Since the smooth surface non-contact portions 18B of the inner peripheral coating layer 18 never make contact with the outer peripheral surface 13B of the wrap portion 13 of the orbiting scroll 11, areas of contact with the wrap portion 13 of the orbiting scroll 11 can be reduced, and therefore, power loss and noise can also be reduced, compared with a case without the smooth surface non-contact portions 18B.

Further, the smooth surface contact portions 18A of the inner peripheral coating layer 18 make contact with the outer peripheral projections 16 of the wrap portion 13 of the orbiting scroll 11 and thus can be readily squashed or worn off when making contact with the outer peripheral projections 16 of the wrap portion 13 of the orbiting scroll 11. In this way, before making contact a large number of times, the smooth surface contact portions 18A can be fitted with the outer peripheral projections 16 of the wrap portion 13 of the orbiting scroll 11. As a result, power loss can be reduced, and damage, noise, galling, and so on can be reduced, resulting in improved durability and reliability.

Further, since the coating layers 17, 18 are formed on the peripheral surfaces 4A, 4B of the wrap portion 4 of the fixed scroll 2, a step of forming the coating layers 17, 18 has to be performed only on the fixed scroll 2. Therefore, productivity can be increased, compared with a case in which coating layers are formed on both the fixed scroll 2 and orbiting scroll 11. The orbiting scroll 11 is provided with the crank 9A, spin-preventing mechanism, and so on, and the fixed scroll 2 is attached to the casing 1. Therefore, the fixed scroll 2 can be attached and removed more easily than the orbiting scroll 11. For example, when the coating layers 17, 18 are worn off significantly with use of the compressor, the fixed scroll 2 can be removed to reapply coating layers 17, 18 or to replace the fixed scroll 2 with another one having new coating layers 17, 18. Therefore, maintenance of the compressor can be conducted more efficiently.

The coating material of the coating layers 17, 18 is "softer than H" in scratch hardness (pencil method) defined by Japanese Industrial Standards K5600-5-4 and "does not crack or peel" in resistance to weight drop defined by Japanese Industrial Standards K5600-5-3. Therefore, adhesiveness of the coating layers 17, 18 to the wrap portion 4 can be enhanced, and cracking and peeling of the coating layers 17, 18 can be prevented, resulting in improved reliability and durability.

Further, the outer peripheral projections 15, 16 of the wrap portions 4, 13 have a cross section comprising concave surfaces 15B, 16B, that is, skirting portions connecting the apexes 15A, 16A and outer peripheral surfaces 4B, 13B of the wrap portions 4, 13. Since the radius R of curvature of the concave surfaces 15B, 16B of the outer peripheral surfaces 15, 16 can be set to about a value equal to or more than the radius (D/2) of a cutting tool (end mill), the outer peripheral projections 15, 16 can be formed, using a cutting tool for forming the wrap portions 4, 13. In this way, the projections can be formed with the wrap portions 15, 16, resulting in improved productivity.

Since the outer peripheral projections 15, 16 are formed on the outer peripheral surfaces 4B, 13B of the wrap portions 4, 13, gaps between adjacent outer peripheral projections 15, 16 can be made larger than, for example, a case in which projections are formed on the inner peripheral surfaces 4A, 13A of the wrap portions 4, 13. As a result, machinability of the outer peripheral projections 15, 16 can be improved. In particular, gaps between adjacent outer peripheral projections 15, 16 become narrow on the inner radial sides of the wrap portions 4, 13. Therefore, on the radially inner sides of the wrap portions 4, 13, there is a large difference in machinability between a case, as in this embodiment, in which the projections 15, 16 are formed on the outer peripheral surfaces 4B, 13B, and a case in which projections are formed on the inner peripheral surfaces 4A, 13A.

Figure 10:
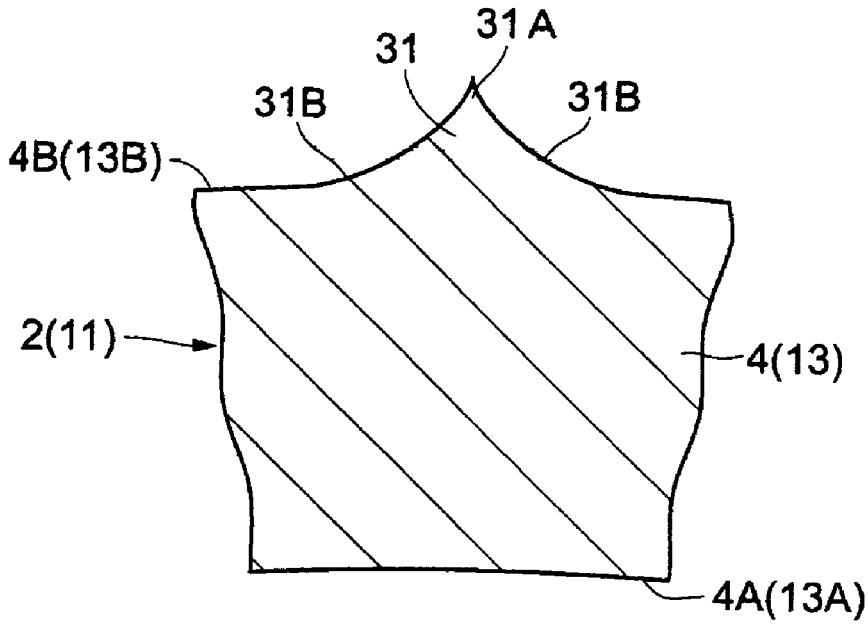
FIG. 10 is an enlarged transverse cross sectional view of the main parts of a projection according to a first modified example.

In the above-described embodiment, the outer peripheral projections 15, 16 comprise: apexes 15A, 16A having narrow, smooth surfaces 15A, 16A; and concave surfaces 15B, 16B which are left and right skirting portions, so as to roughly form a shape of a trapezoid in transverse cross section. However, the present invention is not limited to this. Alternatively, as shown in a first modified example of FIG. 10, for example, a projection 31 can comprise an apex 31A having a sharp tip and concave surfaces 31B which are skirting portions, so as to form a shape of a mountain having a sharp tip in transverse cross section.

Figure 11:
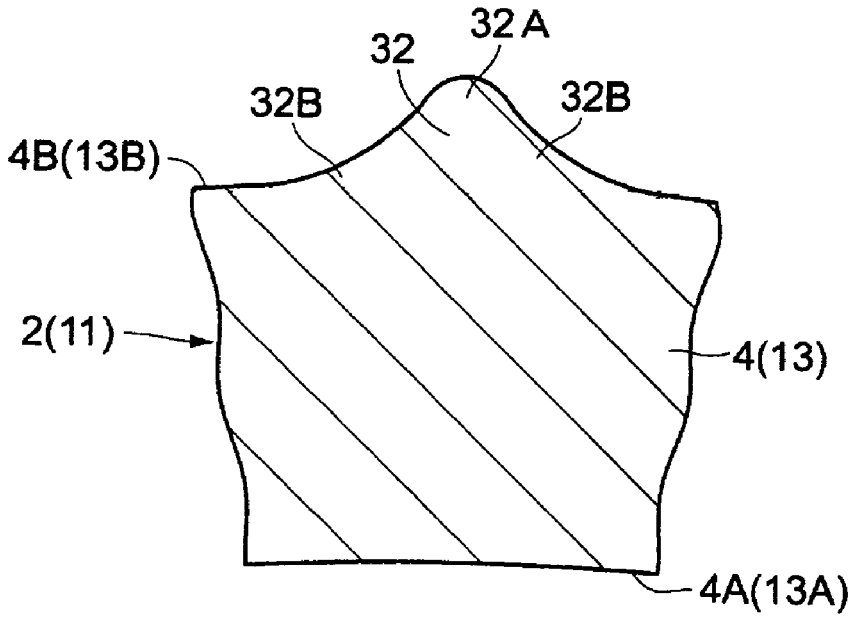
FIG. 11 is an enlarged transverse cross-sectional view of the main parts of a projection according to a second modified example.

Alternatively, as shown in a second modified example of FIG. 11, a projection 32 can comprise: an apex 32A having a convex surface at a tip thereof; and skirting concave surfaces 32B, so as to form a shape of a mountain having a convex tip in transverse cross section. In this case, the transverse cross section of the projection 32 is formed by smoothly connecting between the concave surfaces 32B and apex 32A and between the concave surfaces 32B and outer peripheral surfaces 4B, 13B of the wrap portions 4, 13. In this way, formation of a so-called burr on a coating layer can be prevented when a coating material is applied to the projection 32 to form the coating layer. As a result, adhesiveness of the coating layer can be enhanced, and the coating layer can be prevented from peeling off, resulting in improved reliability and durability.

Figure 12:
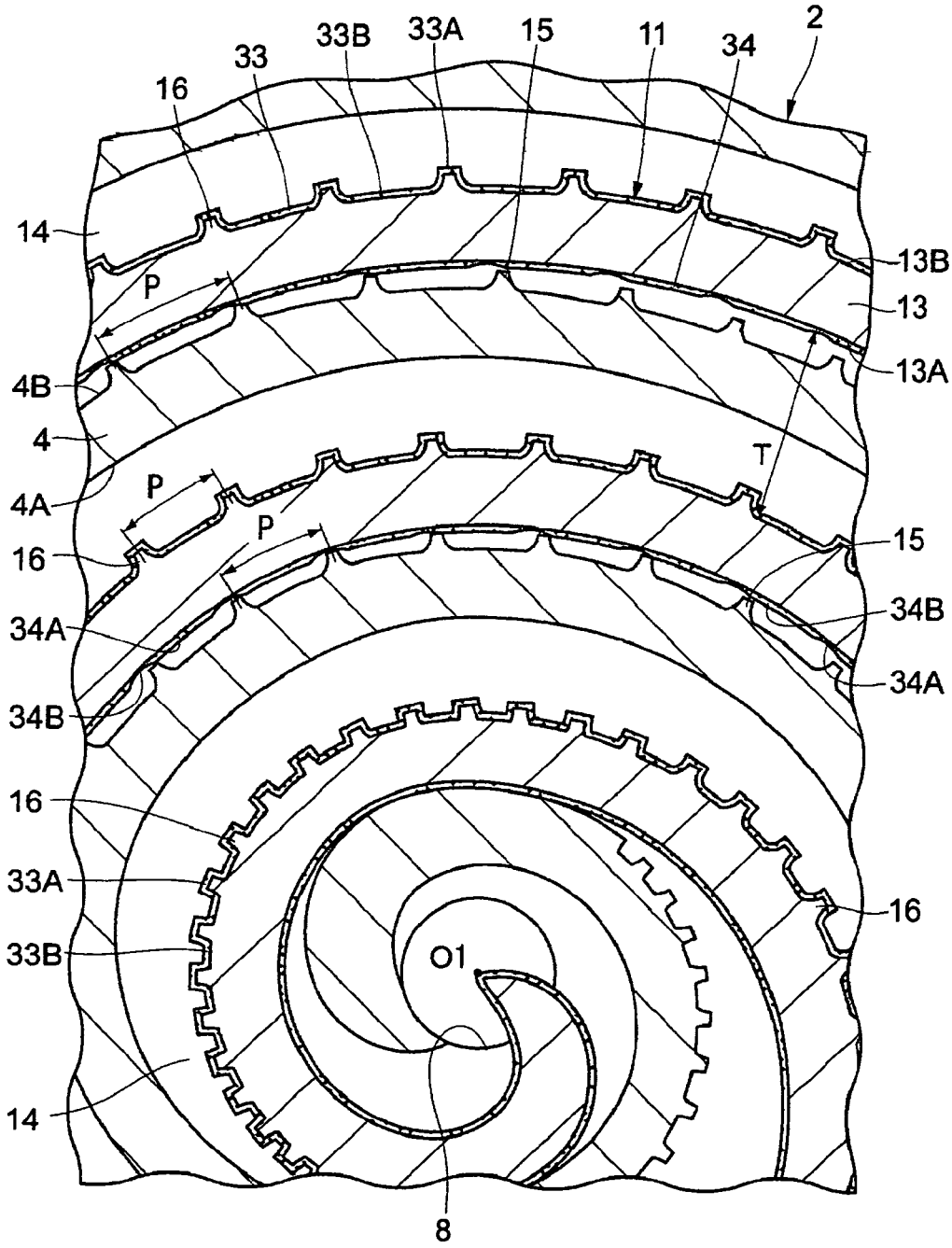
FIG. 12 is an enlarged transverse cross sectional view corresponding in position to that of FIG. 3, showing a wrap portion of a fixed scroll and a wrap portion of an orbiting scroll according to a third modified example.

In this embodiment, the outer peripheral coating layer 17 is applied to the outer peripheral surface 4B of the wrap portion 4 of the fixed scroll 2, and the inner peripheral coating layer 18 is formed on the inner peripheral surface 4A of the wrap portion 4. However, the present invention is not limited to this. As shown in a third modified example of FIG. 12, for example, an outer peripheral coating layer 33 can be formed on the outer peripheral surface 13B of the wrap portion 13 of the orbiting scroll 11, and an inner peripheral coating layer 34 can be formed on the inner peripheral surface 13A of the wrap portion 13. In this case, like the outer peripheral coating layer 17 according to the embodiment, the outer peripheral coating layer 33 has projection surface contact portions 33A and projection surface non-contact portions 33B. Like the inner peripheral coating layer 18 according to the embodiment, the inner peripheral coating layer 34 has smooth surface contact portions 34A and smooth surface non-contact portions 34B.

Figure 13:
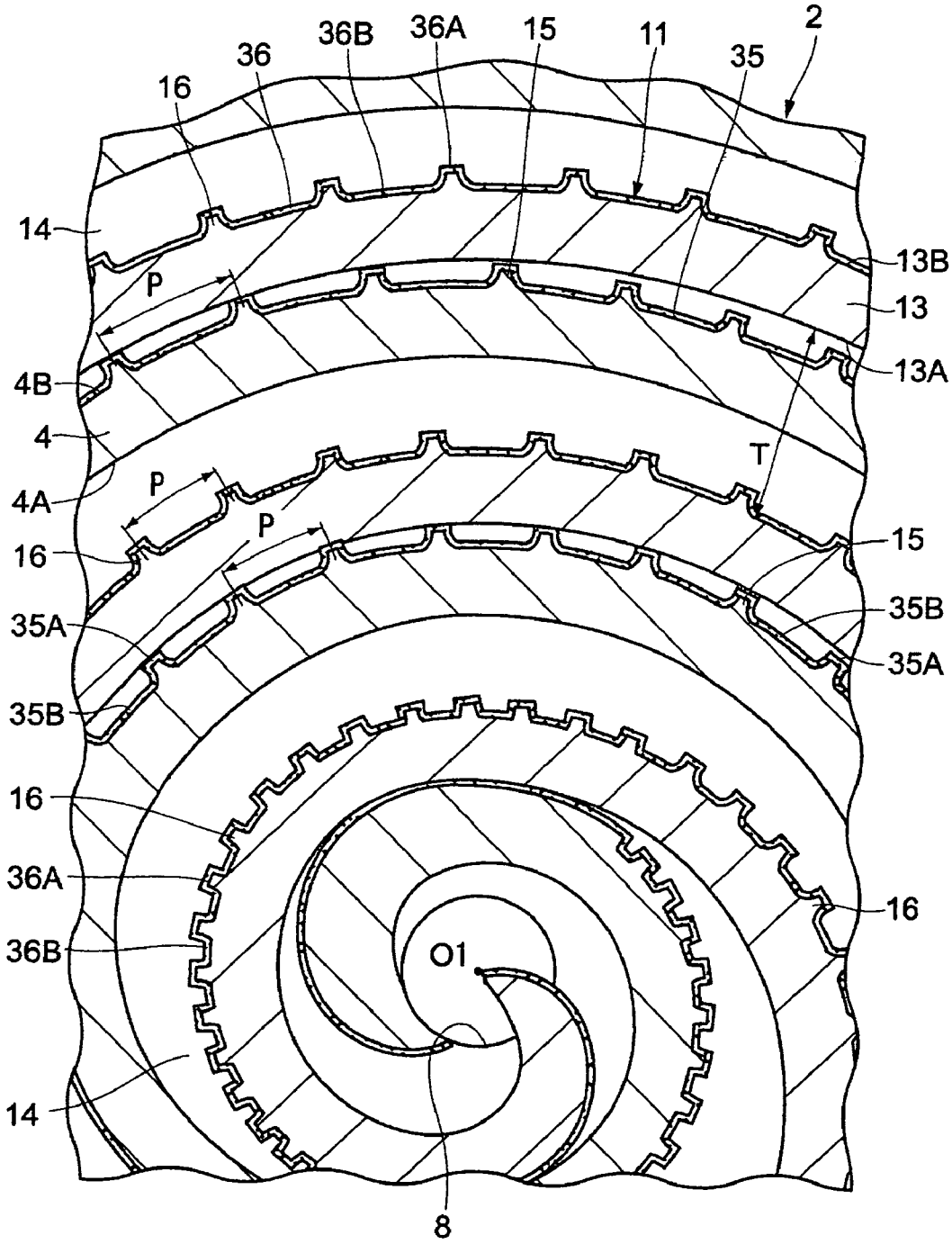
FIG. 13 is an enlarged transverse cross sectional view corresponding in position to that of FIG. 3, showing a wrap portion of a fixed scroll and a wrap portion of an orbiting scroll according to a fourth modified example.

As in a fourth modified example of FIG. 13, outer peripheral coating layers 35, 36 can be formed on the outer peripheral surfaces 4B, 13B of the wrap portions 4, 13 of the scrolls 2, 11. In this case, like the outer peripheral coating layer 17 according to the embodiment, the outer peripheral coating layers 35, 36 comprise projection surface contact portions 35A, 36A and projection surface non-contact portions 35B, 36B.

Figure 14:
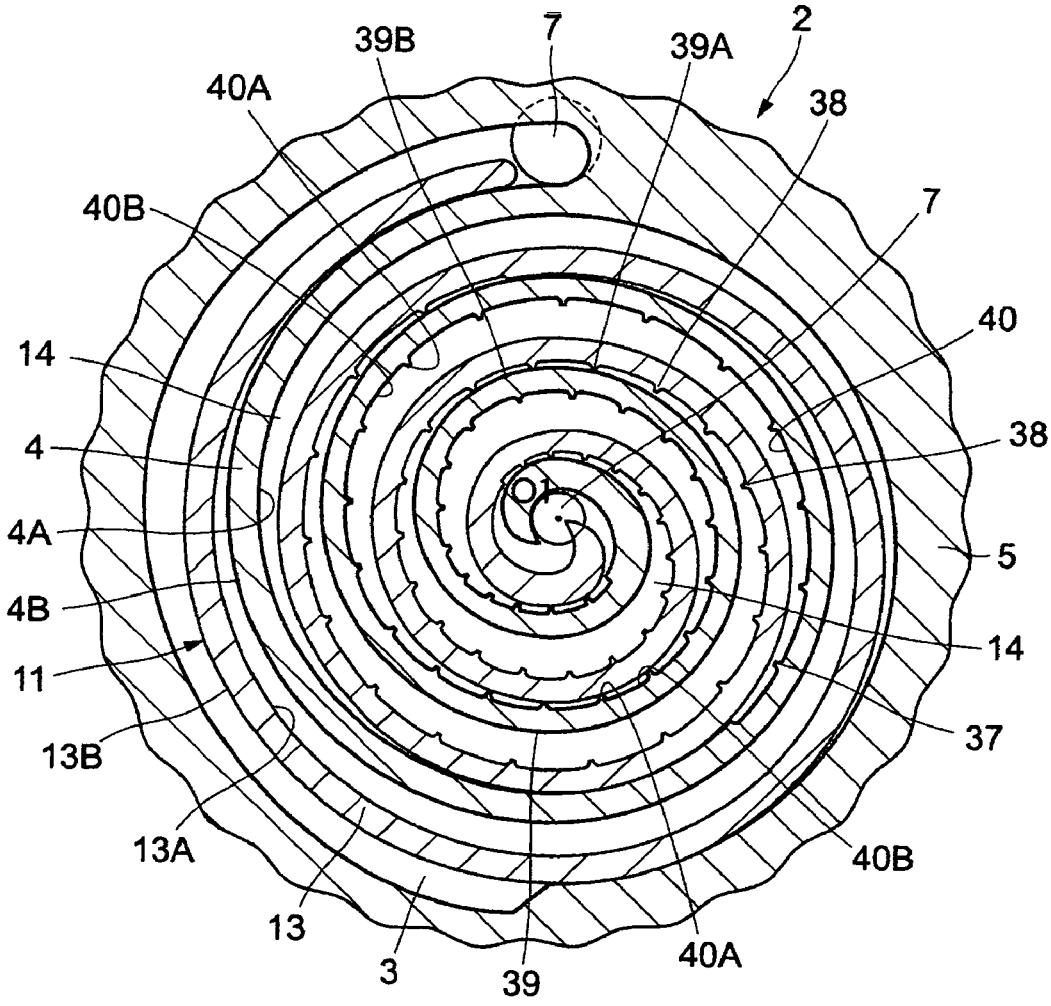
FIG. 14 is a transverse cross sectional view corresponding in position to that of FIG. 2, showing a scroll air compressor according to a fifth modified example.

Further, in the above-described embodiment, the outer peripheral projections 15, 16 are formed on the outer peripheral surfaces 4B, 13B of the wrap portions 4, 13, of the scrolls 2, 11. However, the present invention is not limited to this. For example, as shown in a fifth modified example of FIG. 14, inner peripheral projections 37, 38 can be formed on the inner peripheral surfaces 4A, 13A of the wrap portions 4, 13 of the scrolls 2, 11. In this case, for example, an outer peripheral coating layer 39 is formed on the outer peripheral surface 4B of the wrap portion 4 of the fixed scroll 2, and an inner peripheral coating layer 40 is formed on the inner peripheral surface 4A of the wrap portion 4. Therefore, the outer peripheral coating layer 39 comprises: smooth surface contact portions 39A that make contact with inner peripheral projections 38; and smooth surface non-contact portions 39B that are positioned between adjacent smooth surface contact portions 39A and do not make contact with the inner peripheral surface 13A of the wrap portion 13. The inner peripheral coating layer 40 comprises: projection surface contact portions 40A that make contact with the outer peripheral surface 13B of the wrap portion 13; and smooth surface non-contact portions 40B that are positioned between adjacent projection surface contact portions 40A and do not make contact with the outer peripheral surface 13B of the wrap portion 13.

In the fifth modified example, coating layers can be formed on the inner peripheral surface 13A and outer peripheral surface 13B of the wrap portion 13 of the orbiting scroll 11. Alternatively, coating layers can be formed on the inner peripheral surfaces 4A, 13A of the wrap portions 4, 13 of the scrolls 2, 11.

Figure 15:
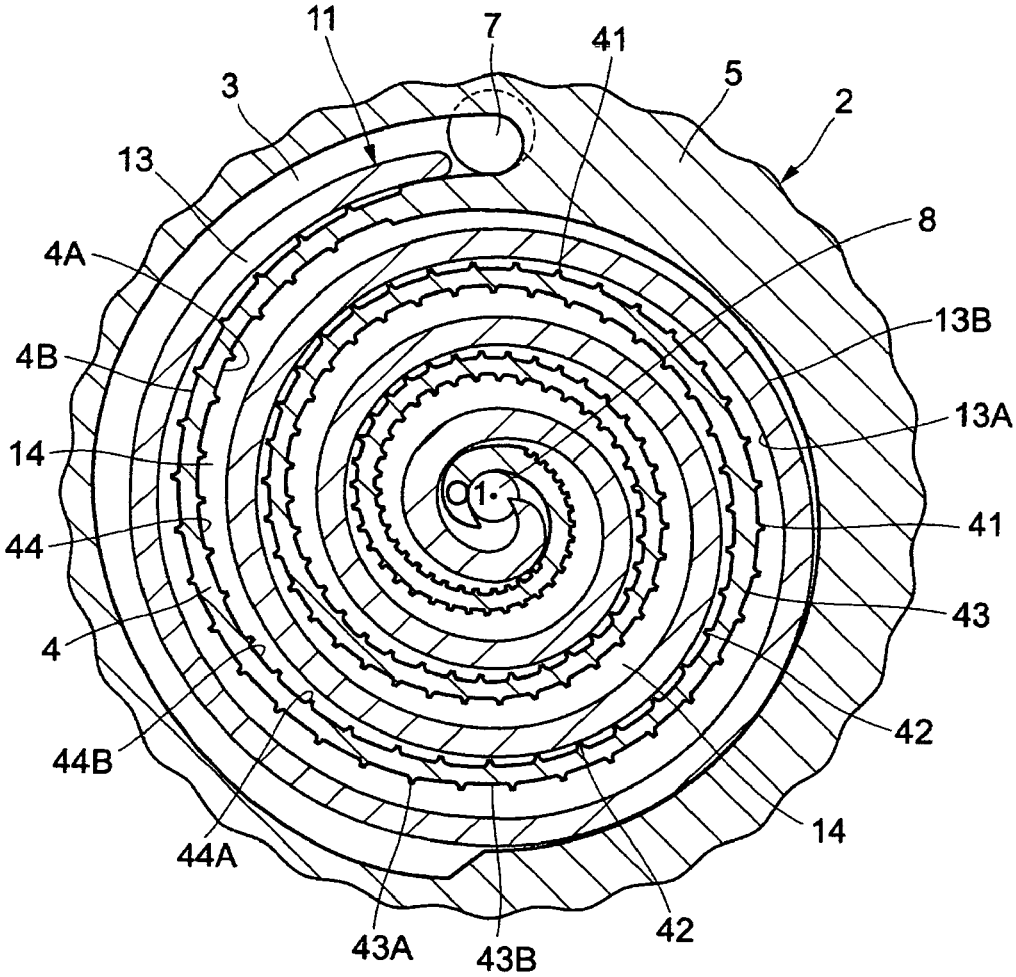
FIG. 15 is a transverse cross sectional view corresponding in position to that of FIG. 2, showing a scroll air compressor according to a sixth modified example.

As shown in a sixth modified example of FIG. 15, without forming projections on the wrap portion 13 of the orbiting scroll 11, outer peripheral projections 41 can be formed on the outer peripheral surface 4B of the fixed scroll 2, and inner peripheral projections 42 can be formed on the inner peripheral surface 4A of the wrap portion 4. In this case, for example, an outer peripheral coating layer 43 is formed on the outer peripheral surface 4B of the wrap portion 4 of the fixed scroll 2, and an inner peripheral coating layer 44 is formed on the inner peripheral surface 4A of the wrap portion 4. Like the outer peripheral coating layer 17 according to the embodiment, the outer peripheral coating layer 43 comprises projection surface contact portions 43A and projection surface non-contact portions 43B. The inner peripheral coating layer 44 comprises: projection surface contact portions 44A that make contact with the outer peripheral surface 13B of the wrap portion 13; and smooth surface non-contact portions 44B that are positioned between adjacent projection surface contact portions 44A and do not make contact with the outer peripheral surface 13B of the wrap portion 13.

In the sixth modified example, instead of the coating layer 44 of the inner peripheral surface 4A of the wrap portion 4 of the fixed scroll 2, a coating layer can be formed on the outer peripheral surface 13B of the wrap portion 13 of the orbiting scroll 11. Instead of the coating layer 43 of the outer peripheral surface 4B of the wrap portion 4 of the fixed scroll 2, a coating layer can be formed on the inner peripheral surface 13A of the wrap portion 13 of the orbiting scroll 11.

In the sixth modified example, projections 41, 42 are formed on the two peripheral surfaces 4A, 4B of the wrap portion 4 of the fixed scroll 2. However, instead of the fixed scroll 2, projections can be formed on the two peripheral surfaces 13A, 13B of the wrap portion 13 of the orbiting scroll 11. In this case, coating layers can be formed on the two peripheral surfaces 13A, 13B of the wrap portion 13 of the orbiting scroll 11. Alternatively, a coating layer can be formed on either one of the peripheral surfaces 13A, 13B, and a coating layer can be formed on a peripheral surface of the wrap portion 4 of the fixed scroll 2 which faces the other one of the peripheral surfaces 13A, 13B.

Figure 16:
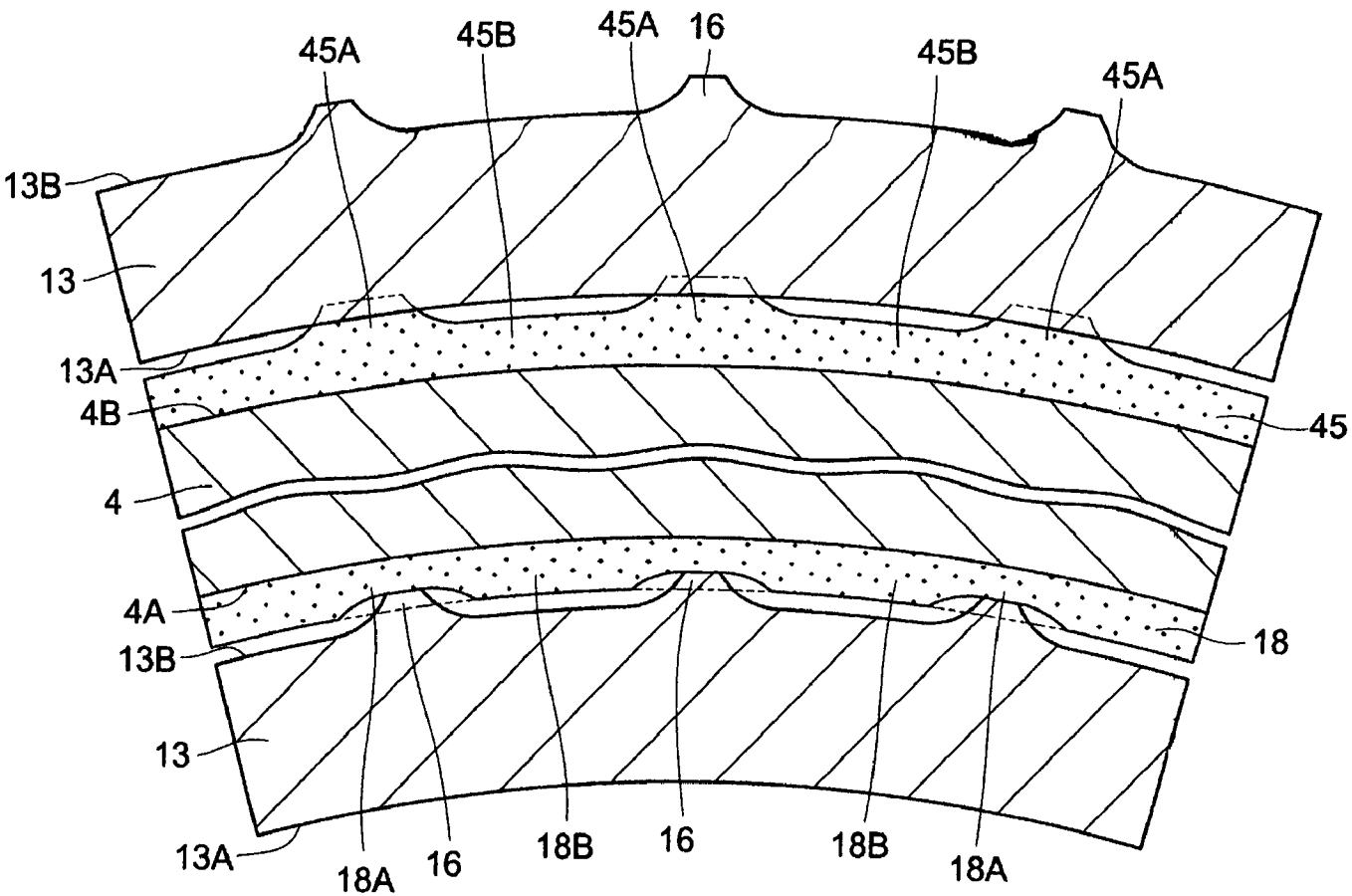
FIG. 16 is an enlarged cross sectional view of the main parts, showing that a wrap portion of a fixed scroll according to a seventh modified example is closest to an inner peripheral surface and an outer peripheral surface of a wrap portion of an orbiting scroll.

In the above-described embodiment, the projections 15 formed on the wrap portion 4 are covered with the coating layer 17 to form the projection surface contact portions 17A on the projections 15. However, the present invention is not limited to this, but, for example, as shown in a seventh modified example of FIG. 16, the outer surface 4B of the wrap portion 4 can be formed in a smooth surface without any projection; a plurality of projection surface contact portions 45A, which project radially outward and make contact with the mating inner peripheral surface 13 of the wrap portion 13, can be formed on the outer peripheral coating layer 45; and projection surface non-contact portions 45B, that do not make contact with the inner peripheral surface 13A of the wrap portion 13, can be formed between adjacent projection surface contact portions 45A.

The above embodiment is described in terms of an example of the scroll air compressor in which the orbiting scroll 11 is rotated with respect to the fixed scroll 2 that is fixed to the casing 1. The present invention is not limited to this, but can be applied to a full-rotating type scroll fluid machine, for example, in which two scrolls disposed facing each other are driven to rotate, respectively, as disclosed in Japanese Patent Application Unexamined Publication (KOKAI) No. Hei 9-133087.

Further, the above embodiment is described in terms of an example in which a scroll air compressor is used as a scroll fluid machine. However, the present application is not limited to this, but can be applied to other scroll fluid machines, e.g. a refrigerant compressor for compressing a refrigerant.

According to one aspect of the present invention, in the scroll fluid machine, a coating layer is formed on at least either one of an inner peripheral surface or an outer peripheral surface of a wrap portion of one scroll, such that the coating layer has: a plurality of projecting contact portions that make contact with a smooth surface of a wrap portion of the other scroll; and non-contact portions that are positioned between the contact portions adjacent to each other and never make contact with a smooth surface of a wrap portion of the other scroll.

In this way, the contact portions of the coating layer make contact with the opposite mating wrap portion (the wrap portion of the other scroll), so as to prevent compressed air from leaking and thus to improve the degree of hermeticity of the compression chambers. Since the non-contact portions of the coating layer does not make contact with the mating wrap portion, areas of contact with the mating wrap portions can be reduced, and thus a power loss and noise can be also reduced, compared to a case where there are no non-contact portions.

Further, the contact portions of the coating layer are formed to project and, therefore, can be readily squashed or made to wear off when they make contact with the mating wrap portion. In this way, the contact portions can be fitted with the peripheral surface of the mating wrap portion before making contact a large number of times. As a result, a power loss can be reduced, and damage, noise, galling, and so on can be prevented, resulting in improved durability and reliability.

A plurality of projections, which are spaced apart from each other in the winding direction and extend in the axial direction, can be formed on at least either one of an inner peripheral surface or an outer peripheral surface of a wrap portion of one scroll. In this case, by forming a coating layer on the peripheral surface of the wrap portion having projections, contact portions that project toward the mating wrap portion can be formed on the projections of the wrap portion, and non-contact portions can be formed between adjacent projections.

In a case in which projections are formed on the outer peripheral surfaces of the wrap portions of the two scrolls, both of the inner peripheral surfaces can be made smooth. In a case in which projections are formed on the inner peripheral surfaces of the wrap portions of the two scrolls, both of the outer peripheral surfaces can be made smooth. Further, a smooth surface coating layer can be formed on a smooth surface of each wrap portion, such that each smooth surface coating layer has: smooth surface contact portions that make contact with the projections of the mating wrap portion; and smooth surface non-contact portions that do not make contact with the mating wrap portion.

In this case, the smooth surface contact portions of the smooth surface coating layer make contact with the projections of the mating wrap portion and thus prevent compressed air from leaking, so as to enhance the degree of hermeticity of the compression chambers. The smooth surface non-contact portions of the smooth surface coating layer never make contact with the mating wrap portion. Therefore, areas of contact with the mating wrap portion can be reduced, and a power loss and noise can be reduced, compared to a case in which there are no smooth surface non-contact portions.

The smooth surface contact portions of the smooth surface coating layer make contact with the projections of the mating wrap portion and thus can be readily squashed or made to wear off. In this way, the smooth surface contact portions can be fitted with the projections of the mating wrap portion before making contact a large number of times. A power loss can be reduced, and damage, noise, galling, and so on can be prevented, resulting in improved durability and reliability.

In a case in which a coating layer is formed on the peripheral surface of the wrap portion of the fixed scroll, a step of forming a coating layer has to be performed only on the fixed scroll. Therefore, productivity can be increased, compared to a case in which coating layers are formed on the fixed scroll and the orbiting scroll. Further, the orbiting scroll is provided with a crank mechanism, spin-preventing mechanism, and so on to perform an orbiting motion. Since the fixed scroll is attached to the casing, the fixed scroll can be attached and removed more readily than the orbiting scroll. Therefore, for example, when the coating layer is worn off significantly with use of the compressor, the fixed scroll can be removed to reapply a coating layer or to replace it with a new fixed scroll. As a result, maintenance of the compressor can be conducted more efficiently.

A coating material can be "softer than H" in scratch hardness (pencil method) defined by Japanese Industrial Standards K5600-5-4 and "does not crack or peel" in resistance to weight drop defined by Japanese Industrial Standards K5600-5-3. In this case, adhesiveness of the coating layer can be enhanced, and cracking and peeling of the coating layer can be prevented, resulting in improved reliability and durability.

The coating material can be an inorganic coating material with a binder that includes titanate or silicate glass and with a solid lubricant that includes graphite, boron nitride, or molybdenum disulfide. In this case, the inorganic coating can be made "softer than H" in scratch hardness and can be made so as "not to crack or peel" in resistance to weight drop.

According to another aspect of the present invention, a fixed-scroll outer peripheral coating layer is formed on the outer peripheral surface of the wrap portion of the fixed scroll and comprises: projection surface contact portions positioned on projections of the wrap portion of the fixed scroll; and projection surface non-contact portions positioned between adjacent projections.

In this way, the projection surface contact portions of the fixed-scroll outer peripheral coating layer make contact with the opposite mating wrap portion (wrap portion of the orbiting scroll) and can prevent compressed air from leaking, so as to enhance the degree of hermeticity of the compression chambers. Further, the projection surface non-contact portions of the fixed-scroll outer peripheral coating layer never make contact with the mating wrap portion. Therefore, areas of contact with the mating wrap portion can be reduced, and a power loss and noise can be reduced, compared to a case where there are no projection surface non-contact portions.

Further, the projection surface contact portions of the fixed-scroll outer peripheral coating layer are formed on the projections of the wrap portion and, therefore, can be readily squashed or made to wear off when making contact with the mating wrap portion. In this way, the projection surface contact portions can be readily fitted with the peripheral surface of the mating wrap portion before making contact a large number of times. Therefore, a power loss can be reduced, and damage, noise, galling, and so on can be prevented, resulting in improved durability and reliability.

A plurality of projections that are spaced apart from each other in the winding direction and extend in the axial direction are formed on the outer peripheral surface of the wrap portion of the fixed scroll. In this way, by forming a coating layer on the outer peripheral surface of the wrap portion of the fixed scroll, projection surface contact portions that project toward the wrap portion of the orbiting scroll can be formed on the projections of the wrap portion, and projection surface non-contact portions can be formed between adjacent projections.

According to another aspect of the present invention, a fixed-scroll outer peripheral coating layer is formed on the outer peripheral surface of the wrap portion of the fixed scroll, and a fixed-scroll inner peripheral coating layer is formed on an inner peripheral surface of the wrap portion of the fixed scroll. The fixed-scroll outer peripheral coating surface comprises: projection surface contact portions positioned on the projections of the wrap portion of the fixed scroll; and projection surface non-contact portions positioned between the adjacent projections. The fixed-scroll inner peripheral coating layer comprises: smooth surface contact portions that make contact with the projections of the wrap portion of the orbiting scroll; and smooth surface non-contact portions that do not make contact with the wrap portion of the orbiting scroll.

In this way, the projection surface contact portions of the fixed-scroll outer peripheral coating layer make contact with the opposite mating wrap portion (the wrap portion of the orbiting scroll) and prevent compressed air from leaking, so as to enhance the degree of hermeticity of the compression chambers. Since the projection surface non-contact portions of the fixed-scroll outer peripheral coating layer never make contact with the mating wrap portion, areas of contact with the mating wrap portion can be reduced, and a power loss and noise can be reduced, compared to a case where there are no projection surface non-contact portions.

Further, the projection surface contact portions of the fixed-scroll outer peripheral coating layer are formed on the projections of the wrap portion, and therefore can be readily squashed or worn off when making contact with the mating wrap portion. Therefore, the projection surface contact portions can be fitted with the peripheral surface of the mating wrap portion before making contact a large number of times. As a result, a power loss can be reduced, and damage, noise, galling, and so on can be reduced, resulting in improved durability and reliability.

A plurality of projections, which are spaced apart from each other in the winding direction and extend in the axial direction, are formed on the outer peripheral surface of the wrap portion of the fixed scroll. In this way, a coating layer can be applied to the outer peripheral surface of the wrap portion of the fixed scroll to form: projection surface contact portions on the projections of the wrap portion, so as to project toward the wrap portion of the orbiting scroll; and projection surface non-contact portions between adjacent projections.

The smooth surface contact portions of the fixed-scroll inner peripheral coating layers make contact with the projections of the wrap portion of the orbiting scroll and therefore prevent compressed air from leaking, so as to enhance the degree of hermeticity of the compression chambers. Further, since the smooth surface non-contact portions of the fixed-scroll inner peripheral coating layer never make contact with the wrap portion of the orbiting scroll, areas of contact with the wrap portion of the orbiting scroll can be reduced, and a power loss and noise can be reduced, compared to a case where there are no smooth surface non-contact portions.

The smooth surface contact portions of the fixed-scroll inner peripheral coating layer make contact with the projections of the wrap portion of the orbiting scroll and thus can be readily squashed or made to wear off when making contact with the projections of the wrap portion of the orbiting scroll. Therefore, the smooth surface contact portions can be fitted with the projections of the wrap portion of the orbiting scroll before making contact a large number of times. As a result, a power loss can be reduced, and damage, noise, galling, and so on can be prevented, resulting in improved durability and reliability.

The projections of the wrap portion can be formed in a cross sectional shape in which skirting portions connecting an apex of each projection and the peripheral surface of the wrap portion are concave surfaces, so as to smoothly connect between the concave surfaces and the apex and between the concave surfaces and the peripheral surface of the wrap portion. In this case, formation of a so-called burr or the like on a coating layer can be prevented when a coating material is applied to the projections to form the coating layer. As a result, adhesiveness of the coating layer can be enhanced, and the coating layer can be prevented from peeling off, resulting in improved reliability and durability.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The present application claims priority under 35 U.S.C. section 119 to Japanese Patent Application No. 2007-022163, filed Jan. 31, 2007. The entire disclosure of Japanese Patent Application No. 2007-022163 including specification, claims, drawings and summary is incorporated herein by reference in its entirety.

The entire disclosure of the Japanese Laid Open Publication No. 2005-076517 including specification, claims, drawings and summary is incorporated herein by reference in its entirety.

The entire disclosure of the Japanese Laid Open Publication No. H09-133087 including specification, claims, drawings and summary is incorporated herein by reference in its entirety.

What is claimed is:

1. A scroll fluid machine comprising:

a first scroll having a first wrap portion spirally wound on and projecting from a first end plate in an axial direction; and a second scroll positioned to face the first scroll and including a second wrap portion that projects from a second end plate in the axial direction, the second wrap portion being spirally wound to overlap the first wrap portion of the first scroll and define a plurality of compression chambers; wherein:

at least one of an inner peripheral surface and an outer peripheral surface of the first wrap portion of the first scroll includes a plurality of first projections that are spaced apart from each other in a winding direction of the first wrap portion, and extend in the axial direction, and a coating layer made of a coating material which is continuously formed;

one of an inner peripheral surface and an outer peripheral surface of the second wrap portion of the second scroll that faces the coating layer is formed to be a smooth surface;

the coating layer comprises i) a first contact portion disposed on each of the first projections and contacting the smooth surface; and ii) a first non-contact portion that is positioned between the contact portion of adjacent first projections, and does not contact the smooth surface; and a thickness C1 of the coating layer is set to satisfy the expression $$B1<C1<A1,$$

in which A1 represents a separation between the peripheral surface of the first scroll, excluding the first projections, and the smooth surface of the second scroll, and B1 represents a separation between the first projections on the coating layer formed on the first scroll excluding the coating layer and the smooth surface of the second scroll at a point at which the first scroll comes closest to the second scroll.

2. A scroll fluid machine according to claim 1, wherein:

the coating layer is formed on the at least one of the surfaces of the first wrap portion that has the first projections;

the first contact portions of the coating layer are disposed at positions of the first projections of the first wrap portion; and the first non-contact portion of the coating layer is disposed between the first projections adjacent to each other.

3. A scroll fluid machine according to claim 2, wherein:

one of the inner peripheral surface and outer peripheral surface of the first wrap portion of the first scroll that is positioned on an opposite side to the peripheral surface having the first projections is formed to be a smooth surface;

one of the inner peripheral surface and outer peripheral surface of the second wrap portion of the second scroll that faces the smooth surface of the first wrap portion of the first scroll is provided thereon with a plurality of second projections that are spaced apart from each other in the winding direction and extend in the axial direction;

a second coating layer made of a coating material is continuously formed on the smooth surface of the first wrap portion of the first scroll; and the second coating layer comprises i) a plurality of second contact portions that have a layer thickness adjusted by contact with the second projections of the second wrap portion of the second scroll and are spaced apart from each other in the winding direction; and ii. a second non-contact portion that is positioned between the smooth surface contact portions adjacent to each other and does not contact with the second wrap portion of the second scroll.

4. A scroll fluid machine according to claim 3, wherein:

the first scroll is a fixed scroll fixed to a casing;

the second scroll is an orbiting scroll that is adapted to rotate with respect to the fixed scroll; and the first coating layer is formed on a peripheral surface of a wrap portion of the fixed scroll.

5. A scroll fluid machine according to claim 3, wherein the projections of the wrap portion have a cross sectional shape in which a skirting portion connecting an apex of each projection and the peripheral surface of the wrap portion is a concave surface that is formed to be smoothly continuous.

6. A scroll fluid machine according to claim 2, wherein the first scroll is a fixed scroll fixed to a casing;

the second scroll is an orbiting scroll that is adapted to rotate with respect to the fixed scroll; and the first coating layer is formed on a peripheral surface of a wrap portion of the fixed scroll.

7. A scroll fluid machine according to claim 2, wherein the projections of the wrap portion have a cross sectional shape in which a skirting portion connecting an apex of each projection and the peripheral surface of the wrap portion is a concave surface that is formed to be smoothly continuous.

8. A scroll fluid machine according to claim 1, wherein the first scroll is a fixed scroll fixed to a casing;

the second scroll is an orbiting scroll that is adapted to rotate with respect to the fixed scroll; and the first coating layer is formed on a peripheral surface of a wrap portion of the fixed scroll.

9. A scroll fluid machine according to claim 8, wherein the projections of the wrap portion have a cross sectional shape in which a skirting portion connecting an apex of each projection and the peripheral surface of the wrap portion is a concave surface that is formed to be smoothly continuous.

10. A scroll fluid machine according to claim 1, wherein the coating material is "softer than H" in scratch hardness defined by Japanese Industrial Standards K5600-5-4 and "does not crack or peel" in resistance to weight drop defined by Japanese Industrial Standards K5600-5-3.

11. A scroll fluid machine according to claim 10, wherein the coating material is an inorganic coating material with a binder that contains titanate or silicate glass and with a solid lubricant that contains graphite, boron nitride, or molybdenum disulfide.

12. A scroll fluid machine according to claim 1, wherein the projections of the wrap portion have a cross sectional shape in which a skirting portion connecting an apex of each projection and the peripheral surface of the wrap portion is a concave surface that is formed to be smoothly continuous.

13. A scroll fluid machine comprising:

a casing in which a driveshaft is adapted to rotate;

a fixed scroll fixed to the casing and provided with a first wrap portion that is spirally wound on and projects from a first end plate in an axial direction; and an orbiting scroll adapted to perform an orbiting motion according to rotation of the driveshaft, positioned to face the fixed scroll, and provided with a second wrap portion that projects from a second end plate in the axial direction, the second wrap portion being spirally wound to overlap the first wrap portion of the fixed scroll and define a plurality of compression chambers; wherein, a plurality of first and second projections, which are spaced apart from each other in a winding direction and extend in the axial direction, are formed on outer peripheral surfaces of the first wrap portion of the fixed scroll and the second wrap portion of the orbiting scroll, respectively;

inner peripheral surfaces of the first wrap portion of the fixed scroll and the second wrap portion of the orbiting scroll are formed to have smooth surfaces;

a fixed-scroll outer peripheral coating layer made of a coating material is formed on the outer peripheral surface of the first wrap portion of the fixed scroll continuously in a circumferential direction;

the fixed-scroll outer peripheral coating layer comprises i) projection surface contact portions that are positioned on the first projections and contact the inner peripheral surface of the second wrap portion of the orbiting scroll;

ii) projection surface non-contact portions that are positioned between the projections adjacent to each other and do not contact the inner peripheral surface of the second wrap portion of the orbiting scroll; and a thickness C1 of the fixed-scroll outer peripheral coating layer is set to satisfy the expression $$B1<C1<A1$$

in which A1 represents a separation between the peripheral surface of the fixed-scroll excluding the first projections, and the smooth surface of the orbiting scroll, and B1 represents a separation between the first projections on the coating layer formed on the fixed-scroll excluding the coating layer and the smooth surface of the orbiting scroll at a point at which the fixed-scroll comes closest to the orbiting scroll.

14. A scroll fluid machine according to claim 13, wherein the coating material is "softer than H" in scratch hardness defined by Japan Industrial Standards K5600-5-4 and "does not crack or peel" in resistance to weight drop defined by Japan Industrial Standards K5600-5-3.

15. A scroll fluid machine according to claim 14, wherein the coating material is an inorganic coating material with a binder that contains titanate or silicate glass and with a solid lubricant that contains graphite, boron nitride, or molybdenum disulfide.

16. A scroll fluid machine according to claim 13, wherein the projections of the wrap portion have a cross sectional shape in which a skirting portion connecting an apex of each projection and the peripheral surface of the wrap portion is a concave surface that is formed to be smoothly continuous.

17. A scroll fluid machine comprising:

a casing in which a driveshaft is adapted to rotate;

a fixed scroll which is fixed to the casing and is provided with a first wrap portion that is spirally wound on and projects from a first end plate in an axial direction; and an orbiting scroll which is adapted to perform an orbiting motion according to rotation of the driveshaft, is positioned to face the fixed scroll, and is provided with a second wrap portion that projects from a second end plate in the axial direction, the second wrap portion being spirally wound to overlap the first wrap portion of the fixed scroll and define a plurality of compression chambers; wherein a plurality of first and second projections, which are spaced apart from each other in a winding direction, extend in the axial direction, and are formed on outer peripheral surfaces of the first wrap portion of the fixed scroll and the second wrap portion of the orbiting scroll, respectively;

inner peripheral surfaces of the first wrap portion of the fixed scroll and the second wrap portion of the orbiting scroll are formed as smooth surfaces;

a fixed-scroll outer peripheral coating layer made of a coating material is formed on the outer peripheral surface of the first wrap portion of the fixed scroll, continuously in a circumferential direction;

a fixed-scroll inner peripheral coating layer made of said coating material is formed on the inner peripheral surface of the first wrap portion of the fixed scroll, continuously in the circumferential direction;

the fixed-scroll outer peripheral coating layer comprises i) projection surface contact portions that are positioned on the first projections and contact the inner peripheral surface of the second wrap portion of the orbiting scroll; and ii) projection surface non-contact portions that are positioned between the projections adjacent to each other and do not contact the inner peripheral surface of the second wrap portion of the orbiting scroll;

a thickness C1 of the fixed-scroll outer peripheral coating layer is set to satisfy the expression $$B1<C1<A1$$

in which A1 represents a separation between the peripheral surface of the fixed-scroll, excluding the first projections, and the smooth surface of the orbiting scroll, and B1 represents a separation between the first projections on the coating layer formed on the fixed-scroll excluding the coating layer and the smooth surface of the orbiting scroll at a point at which the fixed-scroll comes closest to the orbiting scroll;

the fixed-scroll inner peripheral coating layer comprises i) smooth surface contact portions that contact the outer peripheral surface of the second wrap portion of the orbiting scroll; and ii) smooth surface non-contact portions that do not contact the outer peripheral surface of the second wrap portion of the orbiting scroll; and a thickness C2 of the fixed-scroll inner peripheral coating layer is set to satisfy the expression represented by the equation below:

$$B2<C2<A2$$

in which A2 represents a separation between the inner peripheral surface of the fixed-scroll on which the coating layer is formed and the second projection of the orbiting scroll, excluding the second projection, and B2 represents a separation between the inner peripheral surface of the fixed scroll on which the coating layer is formed excluding the coating layer and the second projection of the orbiting scroll at a point at which the fixed-scroll comes closes to the orbiting scroll.

18. A scroll fluid machine according to claim 17, wherein the coating material is "softer than H" in scratch hardness defined by Japan Industrial Standards K5600-5-4 and "does not crack or peel" in resistance to weight drop defined by Japan Industrial Standards K5600-5-3.

19. A scroll fluid machine according to claim 18, wherein the coating material is an inorganic coating material with a binder that contains titanate or silicate glass and with a solid lubricant that contains graphite, boron nitride, or molybdenum disulfide.

20. A scroll fluid machine according to claim 17, wherein the projections of the wrap portion have a cross sectional shape in which a skirting portion connecting an apex of each projection and the peripheral surface of the wrap portion is a concave surface that is formed to be smoothly continuous.

* * * * *